US005837435A

United States Patent [19]

Abe

[11] Patent Number: 5,837,435

[45] Date of Patent: Nov. 17, 1998

[54] LIQUID COLOR DEVELOPER FOR SILVER HALIDE COLOR PHOTOSENSITIVE MATERIALS AND PROCESSING METHOD USING THE SAME

[75] Inventor: Akira Abe, Kanagawa, Japan

[73] Assignee: Fuji Photo Film Co., Ltd., Kanagawa, Japan

[21] Appl. No.: 961,275

[22] Filed: Oct. 30, 1997

Related U.S. Application Data

[63] Continuation of Ser. No. 604,900, Feb. 22, 1996, abandoned.

[30] Foreign Application Priority Data

Feb. 24, 1995 [JP] Japan ..... 7-060119

[51] Int. Cl.[6] ..... G03C 7/413

[52] U.S. Cl. ..... 430/490; 430/464; 430/467; 430/486

[58] Field of Search ..... 430/464, 467, 430/486, 490

[56] References Cited

U.S. PATENT DOCUMENTS

| | | | |
|---|---|---|---|
| 4,814,260 | 3/1989 | Koboshi et al. | 430/464 |
| 5,094,937 | 3/1992 | Morimoto | 430/485 |
| 5,100,765 | 3/1992 | Fujimoto | 430/434 |
| 5,391,467 | 2/1995 | Yoshida et al. | 430/434 |
| 5,422,232 | 6/1995 | Asami et al. | 430/533 |
| 5,429,916 | 7/1995 | Ohshima | 430/538 |
| 5,460,923 | 10/1995 | Goto et al. | 430/455 |
| 5,547,817 | 8/1996 | Okada et al. | 430/393 |

FOREIGN PATENT DOCUMENTS

WO 90/04205 4/1990 WIPO .

*Primary Examiner*—Hoa Van Le
*Attorney, Agent, or Firm*—Sughrue, Mion, Zinn, Macpeak & Seas, PLLC

[57] ABSTRACT

Provided are a liquid color developer suitable for silver halide color photosensitive material, preferably for a silver halide color photosensitive material having a magnetic recording layer on a support, wherein the developer comprises a single solution containing at least one compound represented by the following formula (I) and having specific gravity of from 1.05 to 1.13; and a processing method using the aforementioned liquid color developer:

$$HO—N(R)—L—A \qquad (I)$$

wherein L represents an unsubstituted or substituted alkylene group; A represents a carboxyl group, a sulfo group, a phosphono group, a hydroxy group, or an unsubstituted or alkyl-substituted amino group; and R represents a hydrogen atom, or an unsubstituted or substituted alkyl group.

9 Claims, No Drawings

LIQUID COLOR DEVELOPER FOR SILVER HALIDE COLOR PHOTOSENSITIVE MATERIALS AND PROCESSING METHOD USING THE SAME

This is a Continuation of application Ser. No. 08/604,900 filed Feb. 22, 1996, now abandoned.

FIELD OF THE INVENTION

The present invention relates to a liquid color developer of single-solution type which is used for silver halide color photosensitive materials, and to a processing method using such a liquid color developer. In particular, the invention relates to a liquid color developer which enables easy preparation of a processing solution and causes no deterioration in performances upon long-term storage, and further relates to a liquid color developer, when it is used for processing of a photosensitive material having a magnetic recording layer on a support, hardly induces errors in reading the magnetic information recorded; and also a processing method using the aforementioned developer.

BACKGROUND OF THE INVENTION

A processing agent for silver halide color photosensitive materials is furnished in various forms, such as liquid, powder, granules, tablets, etc. In using the processing agent, it is dissolved in an appropriate volume of water to prepare a processing solution. In the case of a solid processing agent, including powdery, granular and tabular ones, the processing agent is low in dissolution speed, so it becomes necessary for the dissolution thereof to use water warmed up to around 40° C. Thus, a warm water-supplying equipment and an agitation equipment are required therein. Such being the case, the solid form is a very difficult form to deal with in small-scale processing stores called mini- or microlaboratories which have recently increased in number.

In contrast with the solid processing agent, a liquid processing agent can be easily mixed with cold water as well, so it does not require that a warm water-supplying equipment and a special agitation equipment be installed. As a result, it has been prevailed in small-scale stores.

As for the liquid processing agent, however, constituents thereof are subjected to air oxidation and liable to react with each other. Therefore, certain measures have been taken in order to prevent those phenomena and secure long-term storage stability. For instance, the liquid processing agent is partitioned into a plurality of parts, or stored in a vessel having low oxygen permeability for the purpose of preventing oxidation. In the case of a color developer where stability is required, a liquid processing agent is usually partitioned into three parts, namely an alkali agent part, a developing agent part and a preservative (such as hydroxylamine) part.

In many of small-scale stores like minilaboratories, however, processing solutions are prepared by unskilled persons, and so a processing agent partitioned into a plurality of parts is apt to be erroneously mixed. With the intention of removing this drawback, JP-A-63-17453 (the term "JP-A" as used herein means an "unexamined published Japanese Patent Application") discloses the method in which a liquid color developer is made up of a single solution and stored in a vessel made of a material low in both steam permeating speed and oxygen permeating speed, such as polyvinyl chloride, polyethylene terephthalate, nylon or the like, in order to secure the storage stability. The above-cited gazette describes that, in accordance with such a method, the liquid color developer of single-solution type can retain a sufficient quantity of color developing agent even after 10-month storage under ordinary temperature, thereby succeeding in securing good photographic properties.

However, our study has revealed that with all the aforementioned art, though it is certainly effective for the retention of stability of a color developing agent, a reduction in sulfite concentration is caused in the liquid color developer by the storage under a temperature higher than 30° C., as in summer, or the long-term storage over 10 months to give rise to undesirable changes in photographic properties, namely hard gradation enhancement and fog variation.

On the other hand, WO 90/04205 discloses the method in which a magnetic recording layer is provided on the support of a silver halide color photographic material, and therein are formed magnetic records of various pieces of information, such as the information on shooting conditions, that on customer's order, that on printing conditions, etc., and further the records formed are read to make the most of them. However, it has been proved by our review that, when a photosensitive material having a magnetic recording layer was processed with the single-solution type color developer stored under the conditions as described above, the magnetic information recorded in the photosensitive material became considerably difficult to read after the processing.

Although a detailed reason why such a phenomenon occurs is not yet clarified, it can be supposed that substances produced during the storage of the color developer of single-solution type adhere to the surface of the magnetic recording layer, and they are transferred therefrom to a magnetic head upon reading of the magnetic information and accumulated thereon by the repeated reading to deteriorate the magnetic information-reading capability of the magnetic head.

As for the processing of a photosensitive material having a magnetic recording layer, JP-A-06-95316 discloses a method of using a hydroxylamine substituted with an alkyl group or so on in a color developer. The problems studied and solved in the publication are in that the running processing of photosensitive material having magnetic recording layers causes an increase in stain, a lowering of magenta dye density and an increase of a tar product in the color developer, and the publication does not teach influence exerted by long-term storage of a color developer of single -solution type on the reading of magnetic information.

SUMMARY OF THE INVENTION

Therefore, a first object of the present invention is to provide a liquid color developer of single-solution type which enables easy preparation of a processing solution and has high stability enough to cause no changes in photographic performances upon long-term storage under a high temperature.

A second object of the present invention is to provide a liquid color developer of single-solution type which enables easy preparation of a processing solution and, when used for the processing of photosensitive materials having magnetic recording layer after long-term storage under a high temperature, causes no deterioration in readability of magnetic information recorded.

A third object of the present invention is to provide a method of ensuring excellent photographic properties and readability of magnetic information when a liquid color developer of single-solution type is used in the processing of photosensitive materials provided with magnetic recording layers.

The above-described objects of the present invention are attained with a color developer defined below and a processing method using this color developer:

(1) A liquid color developer for silver halide color photosensitive materials, with the developer being a single solution comprising at least one compound represented by the following formula (I) and having specific gravity of from 1.05 to 1.13:

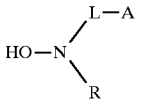

(I)

wherein L represents an unsubstituted or substituted alkylene group; A represents a carboxyl group, a sulfo group, a phosphono group, a hydroxy group, or an unsubstituted or alkyl-substituted amino group; and R represents a hydrogen atom, or an unsubstituted or substituted alkyl group.

(2) A method of processing silver halide color photosensitive materials, wherein the aforementioned liquid color developer (1) is used.

DETAILED DESCRIPTION OF THE INVENTION

The expression "liquid color developer of single -solution type" as used in the present invention signifies one kind of solution stored in one vessel, which can be used as a color developer and/or a color developer replenisher only by undergoing dilution with water or as it is in undiluted condition, and therefore which does not require the admixture with any other ingredients stored in separate vessels.

In addition, the present liquid color developer can achieve its effects to a greater extent when at least 0.01 mole/λ of sulfite is present therein.

The present liquid color developer is prepared so as to have its specific gravity in the range of 1.05 to 1.13, preferably 1.06 to 1.12, particularly preferably 1.08 to 1.10, at 25° C.

On the other hand, the specific gravities of conventionally used color developers and those of their replenishers are in the range 1.035–1.045. Also, the single -solution type liquid color developer disclosed in JP-A-63-17453 cited above has its specific gravity in such a range. That is, the present liquid color developer can be characterized by the specific gravity higher than those of conventional color developers, their replenishers and the above-cited liquid color developer of single-solution type.

The specific gravity adjustment as described above is carried out by controlling the volume of water used for dissolving the ingredients to constitute the liquid color developer. Therein, it is desirable to use water-soluble dissolution aids for the purpose of increasing the solubilities of ingredients used. Suitable examples of such dissolution aids include alcohols such as methyl alcohol, ethyl alcohol, propyl alcohol, isopropyl alcohol, etc., glycols such as ethylene glycol, diethylene glycol, triethylene glycol, polyethylene glycols having molecular weight of at most 6,000, etc., alkanolamines such as diethanolamine, triethanolamine, etc., paratoluenesulfonates such as sodium paratoluenesulfonate, potassium paratoluenesulfonate, and so on. Of these dissolution aids, diethylene glycol and paratoluenesulfonates are preferred over the others.

As another measure to heighten the specific gravity, it is also desirable to add certain ingredients known as constituents of a color developer and a color developer replenisher in proportions greater than usual. Specific examples of such ingredients include sodium carbonate, potassium carbonates, and sodium and potassium salts of chelating agents such as ethylenediaminetetraacetic acid, diethylenetriaminepentaacetic acid, 1-hydroxyethylidene-1,1-diphosphonic acid, hydroxyethyliminodiacetic acid, nitrilotriacetic acid, ethylenediaminetetramethylenephosphonic acid, nitrilotrimethylenephosphonic acid, etc.

Further, it is possible to modify the specific gravity by adding compounds having slight influences upon photographic properties of the color developer. Specific examples of such a specific gravity modifier include sulfates and chlorides of alkali metals, such as sodium sulfate, potassium sulfate, sodium chloride, potassium chloride, etc.; sodium, potassium and lithium salts of organic acids, such as acetic acid, oxalic acid, citric acid, maleic acid, succinic acid, tartaric acid, adipic acid, glycolic acid, lactic acid, glutaric acid, etc.; and sugars such as soluble starch, saccharose, glucose, fructose, etc. In addition, the various monosaccharides described in JP-A-06-102627 may be added.

Also, the sulfinic acids described in JP-A-01-224762, such as paratoluenesulfinic acid, metacarboxysulfinic acid and the like, and the salts thereof can be present in the present color developer.

Of the above-cited specific gravity modifiers, sulfates, sulfinates, soluble starch and saccharose are preferred over the others.

Although a clear account cannot be given of the mechanism of the effect of the specific gravity adjustment in the present invention, it is presumed that changes in rates of absorption of oxygen and carbon dioxide in the air by processing agents are combined with changes in rates of mutual reactions of ingredients in the agents to produce the optimum effect in the specific gravity range of the present invention.

The present compound of formula (I) is described below in detail.

In formula (I), L represents an optionally substituted straight-chain or branched alkylene group containing 1 to 10, preferably 1 to 5, carbon atoms. Specifically, methylene, ethylene, trimethylene and propylene groups are suitable examples thereof. As examples of a substituent which the alkylene group can have, mention may be made of a carboxyl group, a sulfo group, a phosphono group, a hydroxy group, and an amino group which may be substituted with an alkyl group. Of these groups, carboxyl, sulfo and hydroxy groups are preferred over the others. A represents a carboxyl group, a sulfo group, a phosphono group, a hydroxy group, or an amino group which may be substituted with an alkyl group. Of these groups, carboxyl, sulfo and hydroxy groups are preferred over the others. These groups may take the form of sodium, potassium, lithium or like salt.

As for the moiety -L-A, carboxymethyl, carboxyethyl, carboxypropyl, sulfoethyl, sulfopropyl and hydroxyethyl groups are suitable examples thereof.

R represents a hydrogen atom, or an optionally substituted straight-chain or branched alkyl group containing 1 to 10, preferably 1 to 5, carbon atoms. As suitable examples of a substituent which the alkyl group can have, mention may be made of a carboxyl group, a sulfo group, a phosphono group, a hydroxy group, and an amino group which may be substituted with an alkyl group. Of these groups, carboxyl, sulfo and hydroxy groups are preferred over the others. These substituent groups may take the form of sodium, potassium, lithium or like salt.

Specific examples of the present compound are illustrated below, but the invention should not be construed as being limited to these exemplified compounds.

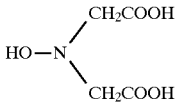
(1)

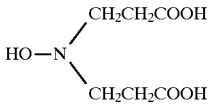
(2)

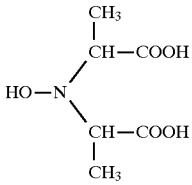
(3)

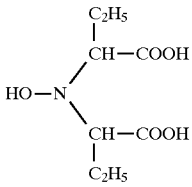
(4)

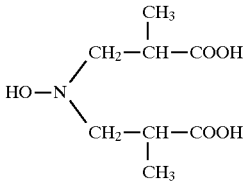
(5)

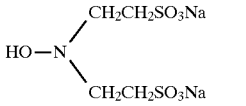
(6)

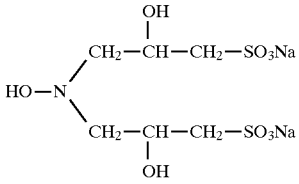
(7)

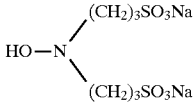
(8)

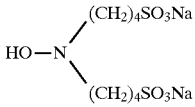
(9)

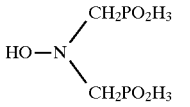
(10)

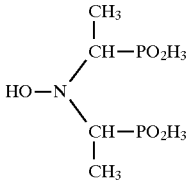
(11)

-continued

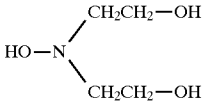
(12)

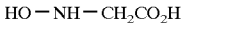
(13)

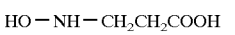
(14)

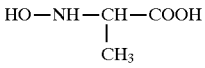
(15)

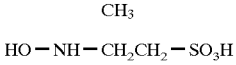
(16)

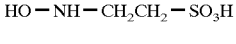
(17)

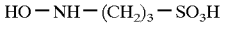
(18)

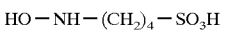
(19)

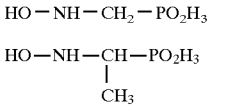
(20)

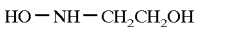
(21)

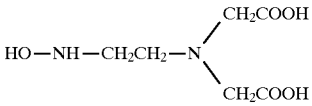
(22)

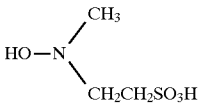
(23)

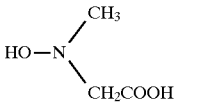
(24)

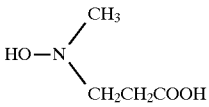
(25)

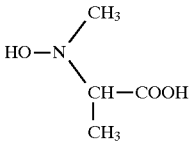
(26)

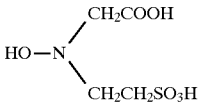
(27)

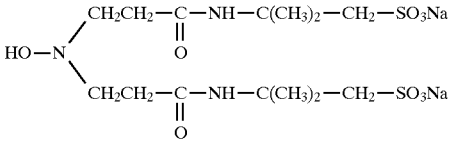
(28)

Of the compounds illustrated above, preferable compounds are Compound (2), Compound (6) and Compound (16), especially Compound (6).

These compounds can be synthesized in accordance with the synthesis methods described in JP-A-03-56456 (which corresponds to U.S. Pat. Nos. 5,262,563 and 5,248,811) and JP -A-03-157354.

In the liquid color developer, it is desirable that the present compound of formula (I) be used in a content of from 0.001 to 0.2 mole per liter, preferably from 0.005 to 0.07 mole per liter, and particularly preferably from 0.01 to 0.05 mole per liter.

The foregoing compounds may be used independently or as a combination of two or more thereof. In the combined use, it is desirable that the total concentration of the compounds of formula (I) be in the above-described range.

In the present liquid color developer, it is desirable that the content of hydroxylamine, which has so far been widely used as preservative, be not more than 0.02 mole/λ, preferably 0.01 mole/λ at the most. In particular, the absence of hydroxylamine is the most favorable for the present liquid color developer.

In view of full achievement of the effects of the present invention, it is desirable that the present liquid color developer be charged into a vessel made of a material having a $CO_2$-permeating speed of 25 ml/($m^2$·24 hrs·atm) or less so that the vessel may range in void rate from 0.15 to 0.05. As for the vessel material, its $CO_2$-permeating speed is preferably not higher than 20 ml/($m^2$·24 hrs·atm), and especially preferably below 15 ml/($m^2$·24 hrs·atm).

Suitable examples of a material having its $CO_2$-permeating speed in the aforementioned range include 300 to 2,000 μm-thick sheets which are made of polyethylene terephthalate, polyvinyl chloride, polyvinylidene chloride, polyethylene-polypropylene laminate, polyethylene-nylon laminate, polyethylene-aluminum laminate, polypropylene -aluminum laminate and glass, respectively. In particular, 500 to 1,000 μm-thick polyethylene terephthalate and polyethylene-nylon laminate sheets are most desirable because the $CO_2$ permeability, the mechanical strength and the weight are well balanced therein.

Further, it is desirable for the vessel material used in the present invention to have an $O_2$-permeating speed of no higher than 20 ml/($m^2$·24 hrs·at.).

The term "void rate" used above is defined as the value obtained by subtracting the volume (ml) of the charged liquid color developer from the volume (ml) of a vessel in which the developer is stored, and further dividing the remainder of the subtraction by the vessel volume. For the present liquid color developer, it is desirable, as described above, to be charged into the aforementioned vessel at a void rate of from 0.15 to 0.05. In particular, it is effective to charge the liquid color developer so that the void rate may range from 0.10 to 0.05, especially from 0.08 to 0.06.

The shape and structure of a vessel in which the present liquid color developer is to be stored can be designed variously depending on the intended uses. However, it is desirable to adopt, for instance, the vessel having an extendable structure like bellows, as described in JP-A-58-97046, JP-A-63-50839, JP-A-01-235950, JP-A-U-63-45555 (the term "JP-A-U" as used herein means an "unexamined published Japanese utility model application") and so on; the vessel having flexible partition wall(s) to enable the waste developer to be stored, as described in JP-A-58-52065, JP-A -62-246061, JP-A-62-134646 and so on; or the structure made up of a plurality of vessels having variable inner volumes which are connected to one another, as described in JP-A-02-264950.

For the purpose of lessening the vessel volume after use to render the waste disposal easy, the vessel structure designed so that the emptied vessel may be readily crushed is particularly preferred. Therefore, it is advantageous to use the above-cited vessel having an extendable structure, such as bellows.

In feeding the liquid color developer from such a vessel as described above into a processing tank installed in a developing machine, the liquid color developer may previously be admitted into a replenisher tank and therein it may be diluted with water automatically or manually, or the processing tank may be fed directly with the liquid color developer and water independently.

In order to smooth the start of such works, it is desirable for the top of the vessel to be designed so as to be opened with only a single action on the top of the vessel. For instance, the tops having the structures as described in JP-A-U-61-128646 and JP-A-03-265849 and JP-A-04-240850 can be adopted.

Silver halide color photosensitive materials suitable for the processing with the present liquid color developer are described below in detail.

The silver halide color photosensitive materials to which the present invention is applicable to advantage are photosensitive materials which can be processed with a color developer containing a sulfite in a proportion of at least 0.01 mole/λ. Specific examples of such materials include silver chlorobromide emulsion- or silver bromide emulsion-coated color papers and color auto positive papers, and silver iodobromide emulsion-coated color negative films, color reversal films and color reversal papers. Of these materials, color negative films are more appropriate to the present invention. In particular, the present invention prefers a color negative film of the type which has a magnetic recording layer on the back side of a support.

The photosensitive material of the type which has a magnetic recording layer, which is appropriate for the processing with the present liquid color developer, is illustrated below.

The magnetic recording layer is formed by coating on a support a water-base or organic solvent-base composition comprising a magnetic powder dispersed in a binder. Specific examples of a magnetic powder which can be used therein include ferromagnetic iron oxides such as $\gamma Fe_2O_3$, etc., Co -covered $\gamma Fe_2O_3$, Co-covered magnetite, Co-containing magnetite, ferromagnetic chromium dioxide, ferromagnetic metals, ferromagnetic alloys, hexagonal-system Ba ferrite, Sr ferrite, Pb ferrite, Ca ferrite and the like. Of these magnetic powders, Co-covered ferromagnetic iron oxides such as Co-covered $\gamma$-$Fe_2O_3$ are preferred over the others.

Such magnetic powders may have any of the crystal forms including needles, rice grains, cubes, plates and the like. The specific surface area thereof is preferably not less than 20 $m^2$/g, particularly at least 30 $m^2$/g, in terms of $S_{BET}$. The saturation magnetization ($\sigma_s$) of the above-cited ferromagnetic materials is preferably from $3.0\times10^4$ to $3.0\times10^5$ A/m, particularly from $4.0\times10^4$ to $2.5\times10^5$ A/m. Those ferromagnetic powders may be subjected to a surface treatment with silica and/or alumina, or an organic substance. Further, the magnetic powders may undergo the surface treatment with a silane coupling agent or a titanium coupling agent. Also, the magnetic powders coated with inorganic or organic substances as described in JP-A-04-259911 and JP-A -05-81652 can be used.

As for the binder in which the magnetic powder as cited above is dispersed, those described in JP-A-04-219569, including thermoplastic resins, thermosetting resins, radiation-curable resins, reactive resins, acid or alkali-decomposable polymers, polymers capable of undergoing biodegradation, natural polymers (e.g., cellulose derivative, sugar derivatives) and mixtures of two or more thereof. It is desirable for those resins to have their glass transition temperature Tg in the range of −40° C. to 300° C. and their weight-average molecular weight in the range of $0.2\times10^4$ to $1.00\times10^6$. As examples of such resins, mention may be made of vinyl copolymers, cellulose derivatives such as cellulose diacetate, cellulose triacetate, cellulose acetate propionate, cellulose acetate butyrate, cellulose tripropionate, etc., acrylic resins, polyvinyl acetal resins and so on. Also, gelatin is used to advantage. In particular, cellulose diacetate and cellulose triacetate are preferred over the others. On the other hand, binders of the type which can be cured by the addition of an epoxy, aziridine or isocyanate crosslinking agent may be used. Specific examples of an isocyanate crosslinking agent include isocyanates, such as tolylenediisocyanate, 4,4'-diphenylmethanediisocyanate, hexamethylenediisocyanate, xylylenediisocyanate, etc.; the reaction products of those isocyanates with polyhydric alcohols, such as the reaction product of 3 moles of tolylenediisocyanate and 1 mole of trimethylolpropane; and polyisocyanates produced by condensation of those isocyanates, which are described, e.g., in JP-A-06-59357.

In dispersing the magnetic powder as described above into the foregoing binders, the method as described in JP-A -06-35092, wherein a kneader, a pin mill, or the like is used independently or in combination, is adopted to advantage. Further, the dispersing agent described in JP-A-05-088283 and other known dispersing agents can be used.

The magnetic recording layer has a thickness of from 0.1 to 10 $\mu$m, preferably from 0.2 to 5 $\mu$m, and more preferably from 0.3 to 3 $\mu$m. The ratio of the magnetic powder to the binder is preferably from 0.5:100 to 60:100 by weight, and more preferably from 1:100 to 30:100 by weight. The coverage of the magnetic powder ranges from 0.005 to 3 $g/m^2$, preferably from 0.01 to 2 $g/m^2$, and more preferably from 0.02 to 0.5 $g/m^2$.

The magnetic recording layer relating to the present invention can be formed on the back side of a photographic support all over or in the form of stripes by a coating or printing operation. As examples of a coating method adopted therein, mention may be made of various methods such as air doctor coating, blade coating, air knife coating, squeegee coating, impregnation coating, reverse roll coating, transfer roll coating, gravure coating, kiss coating, cast coating, spray coating, dip coating, bar coating, extrusion coating, etc. The coating compositions described, e.g., in JP-A-05-341436 are preferably used.

The magnetic recording layer may have various functions, e.g., lubricity enhancement, curl control, prevention of electrification, prevention of adhesion, head polishing, etc., or a functional layer having those functions may be provided additionally. In such a layer, it is desirable to contain at least one kind of abrasive constituted of aspherical inorganic particles having a Mohs' hardness of at least 5. As for the composition of such aspherical inorganic particles, oxides such as aluminum oxide, chromium oxide, silicon dioxide, titanium dioxide, etc., carbides such as silicon carbide, titanium carbide, etc., and fine particles of diamond or the like are examples thereof. These abrasives may be subjected to the surface treatment with a silane coupling agent or a titanium coupling agent. These particles may be added to the magnetic recording layer or coated over the magnetic recording layer (as a protective or lubricant layer). The binder used therein may be any of the aforementioned ones, but the same binder as used in the magnetic recording layer is preferable. For details of the photosensitive materials provided with magnetic recording layers, U.S. Pat. Nos. 5,336,589, 5,250,404, 5,229,259 and 5,215,874, and European Patent 466,130 can be referred to.

The photosensitive materials processed with the present liquid color developer are preferably those for picture-taking use, and it is desirable for their supports to be polyester films. The details thereof are described in Japanese Kokai Giho, Kogi (Journal of Technical Disclosure) No. 94-6023 (published in Mar. 15, 1994, by Hatsumei Kyokai (which means "the Inventional Association")).

The polyesters used in the present invention are prepared using diols and aromatic dicarboxylic acids as essential components. As for the aromatic dicarboxylic acids, 2,6-, 1,5-, 1,4- and 2,7-naphthalenedicarboxylic acids, terephthalic acid, isophthalic acid and phthalic acid are examples thereof. As for the diols, diethylene glycol, triethylene glycol, cyclohexanedimethanol, bisphenol A and bisphenol are examples thereof. Suitable examples of a polyester thus prepared include homopolymers such as polyethylene terephthalate, polyethylene naphthalates, polycyclohexanedimethanol terephthalate and the like. Of these polyesters, especially favorable ones are polyesters containing 50 to 100 mole % of 2,6-naphthalenedicarboxylic acid as the aromatic dicarboxylic acid component. In particular, polyethylene 2,6-naphthalate is preferred over the other polyesters. As for the average molecular weight thereof, the range of about 5,000 to about 200,000 is appropriate. The Tg of polyesters which can be used in the present invention is not lower than 50° C., preferably 90° C. at the lowest.

For the purpose of rendering a polyester support hard to curl, the polyester support is subjected to a heat treatment at a temperature ranging from 40° C. to not higher than Tg, preferably from Tg-20° C. to not higher than Tg. The heat treatment may be carried out within the foregoing temperature range as the temperature is kept constant or rendered lower and lower. A suitable heat treatment time ranges from 0.1 to 1,500 hours, preferably from 0.5 to 200 hours. The support may undergo the heat treatment in the form of roll or as it travels through a heating zone in the form of web. The surface condition of the support may be improved by providing the surface with roughness (e.g., by coating the surface with fine grains of a conductive inorganic compound, such as $SnO_2$, $Sb_2O_5$, etc.). Further, it is desirable to use a device, e.g., such that only the edge part is slightly risen thereto so that the roll core part may not bear marks of a cut end line. Such a heat treatment may be carried out at any stage, e.g., after forming the film as a support, after undergoing the surface treatment, after coating a backing layer (comprising, e.g., an antistatic agent, a lubricant, etc.) or after coating a subbing layer. However, it is preferable for the heat treatment to be carried out after the coating with an antistatic agent.

The polyesters as described above may be kneaded together with ultraviolet absorbents. Further, dyes or pigments which are commercially available for polyester use, e.g., Diaresin (trade name, a product of Mitsubishi Chemical Industries, Ltd.) and Kayaset (trade name, a product of Nippon Kayaku Co., Ltd.) can be mixed with the polyesters by kneading for the purpose of preventing a light-piping phenomenon.

In the photosensitive materials for the present invention, it is desirable that their supports undergo a surface treatment in order to effect the adhesion to their constituent layers. As examples of such a surface treatment, mention may be made of surface-activating treatments such as a chemical treatment, a mechanical treatment, a corona discharge treatment, a flame treatment, a UV treatment, a high frequency treatment, a glow discharge treatment, an active plasma treatment, a laser treatment, a mixed acid treatment, an ozone oxidation treatment and so on. Of these treatments, a UV treatment, a flame treatment, a corona discharge treatment and a glow discharge treatment are preferred over the others.

Subbing layers which can be provided in the photosensitive materials for the present invention are described below. Such a subbing layer may be a single layer, or may be constituted of two or more layers. Suitable examples of a binder for the subbing layer include not only copolymers using as starting materials the monomers selected among vinyl chloride, vinylidene chloride, butadiene, methacrylic acid, acrylic acid, itaconic acid, maleic anhydride and so on, but also polyethyleneimine, epoxy resins, grafted gelatins, nitrocellulose and gelatin. In the subbing layer, a compound capable of making the polyester support swell, such as resorcin and p-chlorophenol, can be present. Further, the subbing layer can contain a gelatin hardener such as chromium salts (e.g., chrome alum), aldehydes (e.g., formaldehyde, glutaraldehyde), isocyanates, active halogen compounds (e.g., 2,4-dichloro-6-hydroxy-s-triazine), epichlorohydrin resins, active vinylsulfone compounds and so on. Furthermore, the subbing layer may contain as a matting agent fine grains of inorganic substances, such as $SiO_2$, $TiO_2$, etc., or fine particles (0.01–10 $\mu$m) of a methylmethacrylate copolymer.

In the photosensitive materials for the present invention, it is desirable to use an antistatic agent. As examples of such an antistatic agent, mention may be made of carboxylic acids, carboxylates, polymers containing sulfonates, cationic polymers, and ionic surfactants.

Most preferred antistatic agents are, however, fine grains or sol-state fine grains of crystalline metal oxide or complex metal oxide thereof having a volume resistivity of not greater than $10^7$ Ω·cm , preferably not greater than $10^5$ Ω·cm, and a grain size of from 0.001 to 1.0 $\mu$m, which is selected from the group consisting of ZnO, $TiO_2$, $SnO_2$, $Al_2O_3$, $In_2O_3$, $SiO_2$, MgO, BaO, $MoO_3$, $V_2O_5$ and mixtures of two or more thereof. The content of such an antistatic agent in a photosensitive material is preferably from 5 to 500 mg/$M^2$, and particularly preferably from 10 to 350 mg/$m^2$. The ratio of a conductive crystalline simple or compound oxide to a binder is preferably from 1/300 to 100/1, and more preferably from 1/100 to 100/5.

In addition, it is desirable for the photosensitive materials to have lubricity. A lubricant containing layer is preferably provided on both the photosensitive layer side and the back side. In general, desirable lubricity is from 0.25 to 0.01 in terms of kinematic friction coefficient.

Specific examples of a lubricant which can be used include organopolysiloxanes, higher fatty acid amides, metal salts of higher fatty acids and higher fatty acid esters of higher alcohols. As for the organopolysiloxanes, polydimethylsiloxane, polystyrylmethylsiloxane and polymethylphenylsiloxane are examples thereof. It is desirable for such lubricants to be added to the outermost emulsion layer and the backing layer. In particular, polydimethylsiloxane and long-chain alkyl containing esters are used to advantage in those layers.

Further, it is desirable that a matting agent be present in the photosensitive materials. The matting agent may be present on either side of the support, but it is desirable for the matting agent to be added to the outermost layer on the emulsion layer side. Any matting agents, soluble or insoluble in the processing solution, can be used, but the combined use of both soluble and insoluble matting agents is preferable to their individual use. Suitable examples of a matting agent include polymethylmethacrylate particles, methylmethacrylate/methacrylic acid (9/1 or 5/5 by mole) copolymer particles and polystyrene particles. It is preferable for the particle size to range from 0.8 to 10 $\mu$m, and for the size distribution to be narrow. Specifically, it is desirable that at least 90% of the total particles have their individual sizes within the range of 0.9 to 1.1 times the average particle size.

In addition to the above-described matting agents, it is desirable to add fine particles whose sizes are smaller than 0.8 $\mu$m for the purpose of heightening the matting capacity. As for the fine particles which can be added simultaneously, polymethylmethacrylate particles (0.2 $\mu$m), methylmethacrylate/methacrylic acid (9/1 by mole) copolymer particles (0.3 $\mu$m), polystyrene particles (0.25 $\mu$m) and colloidal silica (0.03 $\mu$m).

A patrone (or cartridge) which can be loaded with a photosensitive material to be processed with the present liquid color developer is described below. The patrone used in the present invention may be made mainly from metal or synthetic plastics, but it is preferable for the patrone to be made from plastic materials, such as polystyrene, polyethylene, polypropylene, polyphenyl ether and the like.

The patrone used in the present invention may contain various antistatic agents. For instance, carbon black, metallic oxide particles, and nonionic, anionic, cationic and betaine surfactants and polymers are preferred as the antistatic agents used in the patrone. As for the patrone rendered antistatic, JP-A-01-312537 and JP-A-01-312538 have the descriptions thereof. In particular, it is desirable for the patrone to have an electric resistance of no higher than $10^{12}$ Ω at 25° C.-25% RH. In general, a plastic patrone is made from the plastics in which carbon black or a pigment is incorporated by kneading for the purpose of providing light-shielding properties. As for the patrone size, the current 135-size may be adopted as it is, and it is also effective to reduce the cartridge diameter from 25 mm in the case of the current 135-size to 22 mm so as to meet the reduction in camera size. The case volume of the patrone is preferably not greater than 30 $cm^3$, and more preferably not greater than 25 $cm^3$. The weight of plastics used for a patrone and a patrone case is preferably from 5 to 15 g.

Further, the patrone may have such a structure as to send a film out by the rotation of a spool, or another structure in which the top of a film is stored in the patrone proper and sent out of the port part of the patrone toward the outside by rotating the spool pivot in the forward direction of the film. These structures are disclosed in U.S. Pat. Nos. 4,834,306 and 5,226,613.

The development-processed photosensitive material can be stored again in a patrone. The patrone used therein may be the same one as used before the processing, or may be a different one.

The present liquid color developer and the processing method using this developer are described below in detail.

In the present liquid color developer, the compounds described in JP-A-04-121739, from page 9, right upper column, line 1, to page 11, left lower column, line 4, can be used. In a rapid processing where the color development time is reduced to not longer than 2.5 minutes, 2-methyl-4-[N-ethyl-N-(2-hydroxyethyl)amino]aniline, 2-methyl-4-[N-ethyl-N-(3-hydroxypropyl)amino]aniline, and 2-methyl-4-[N-ethyl-N-(4- hydroxybutyl)amino]aniline are particularly preferred as a color developing agent.

It is desirable that such a color developing agent be present in the liquid color developer in a concentration of from 0.01 to 0.2 mole/λ, preferably from 0.02 to 0.1 mole/λ, and particularly preferably from 0.3 to 0.08 mole/λ.

In a color developer prepared from the present liquid color developer, the color developing agent as cited above is present in a concentration of desirably from 0.01 to 0.08 mole/λ, preferably from 0.015 to 0.06 mole/λ, and particularly preferably from 0.02 to 0.05 mole/λ. As for the replenisher of the color developer, it is desirable that the color developing agent concentration be 1.1 to 3 times as high as that in the color developer.

In the present liquid color developer, it is desirable that a sulfite such as sodium sulfite, potassium sulfite or the like be present. The sulfite concentration therein is desirably from 0.01 to 0.2 mole/λ, preferably from 0.03 to 0.15 mole/λ, and particularly from 0.04 to 0.1 mole/λ. In the practical processing, it is desirable for the sulfite concentration to be adjusted to 0.01 to 0.05 mole/λ in the color developer, while in the replenisher it is desirably adjusted to 1.3 to 3 times as high as the sulfite concentration in the color developer.

The suitable pH range for the present liquid color developer is from 9.8 to 12, especially 10 to 11. For the color developer prepared from this liquid color developer, it is desirable to be adjusted to pH 10–10.5; while for the replenisher thereof, it is desirable to be adjusted to pH 10.2–10.7. For the pH adjustment, hydroxides of alkali metals, such as potassium hydroxide, sodium hydroxide, etc., and known pH buffers, such as carbonates, phosphates, sulfosalicylates, borates, etc., are used. As for the pH buffers, carbonates are preferred in particular.

The replenishment rate of the color developer is desirably from 80 to 1,300 ml per $m^2$ of the photosensitive material processed. From the standpoint of reduction in load of environmental pollution, however, it is advantageous that the replenishment rate be as low as possible. Accordingly, the replenishment rate is preferably from 80 to 600 ml, particularly preferably from 80 to 400 ml, per $m^2$ of the photosensitive material processed.

The bromide ion concentration in the color developer is, in general, within the range of 0.01 to 0.06 mole/λ; but preferably, it is set up within the range of 0.015 to 0.03 mole/λ with the intention of preventing the fog generation without accompanied with sensitivity drop to enhance the discrimination, and improving the graininess as well. When the bromide ion in the color developer is adjusted to the foregoing concentration range, the bromide ion concentration in the replenisher may be controlled so as to satisfy the following relation:

$$C=A-W/V$$

wherein C is a bromide ion concentration (mole/λ) in the replenisher of the color developer, A is the intended concentration of bromide ion in the color developer (mole/λ), W is the amount of bromide ion eluted from a 1 $m^2$ of photosensitive material with the color developer, and V is a volume (λ) of the replenisher used for the development of the 1 $m^2$ of photosensitive material.

To the present liquid color developer, bromides are added in an amount meeting the requirement for the bromide ion concentration in the aforementioned color developer or the replenisher thereof. Accordingly, bromides may be added to the present liquid developer, or may not added thereto at all.

In cases where the replenishment rate is lowered or a high bromide ion concentration is chosen, it is to be desired for the purpose of increasing the sensitivity that pyrazolidones represented by 1-phenyl-3-pyrazolidone and 1-phenyl-2-methyl-2-hydroxymethyl-3-pyrazolidone, thioether compounds represented by 3,6-dithia-1,8-octanediol, sodium thiosulfate, potassium thiosulfate or/and so on be used as development accelerator.

Also, those development accelerator can be used in the present liquid color developer.

The present liquid color developer can be used as color developer or replenisher as it is, but preferably it is diluted with water at the time when it is used as color developer or replenisher in practice. In preparing a color developer from the present liquid color developer, it is desirable to add a starter comprising pH controlling agents and bromides in addition to water.

In preparing a replenisher form the present liquid color developer, on the other hand, the following known manners may be adopted: One manner comprises previously mixing and diluting the liquid color developer with water and stocking it in a replenisher tank, and replenishing a processing tank with prescribed portions of the stock solution; another manner comprises directly replenishing a processing tank with prescribed portions of water and the liquid color developer respectively so as to mix and dilute the developer with water in the processing tank; and still another method, which is an intermediate between the foregoing manners, comprises continuously mixing the liquid color developer with water for dilution and feeding the resulting mixture into a processing tank. In the last manner, a mixing tank may be arranged on the way to the processing tank.

Processing solutions other than a color developer and processing methods therefor are illustrated below.

To a processing solution having a bleaching capacity which can be used in the present invention, it is advantageous to employ the compounds and the processing conditions described in JP-A-04-125558, from page 4, left lower column, line 16, to page 7, left lower column, line 6. It is desirable for the bleaching agent to have an oxidation-reduction potential of at least 150 mV. Specific examples of such a bleaching agent include the compounds described in JP-A-05-72694 and JP-A-05-173312. In particular, 1,3-diaminopropanetetraacetic acid and the Fe(III) complex salt of the compound cited as Specific Example 1 at page 7 in JP-A-05-173312 are preferred over the others.

For the purpose of enhancing the biodegradation suitability of a bleaching agent, it is desirable that the Fe(III) complex salts of the compounds described in JP-A-04-251845, JP-A-04-268552, EP-A-0588289, EP-A-0591934 and JP-A-06-208213 be used as bleaching agent. The concentration of such a bleaching agent in a solution having a bleaching capacity is desirably from 0.05 to 0.3 mole/λ. In order to reduce the amount discharged into surroundings, it is to be desired that the solution having a bleaching capacity be designed so as to have the bleaching agent concentration within the range of 0.1 to 0.15 mole/λ. In a case where the solution having a bleaching capacity is a bleaching solution, it is desirable for the solution to contain a bromide in a concentration of 0.2 to 1 mole/λ, particularly 0.3 to 0.8 mole/λ.

In the replenisher for a solution having a bleaching capacity, it is to be desired that each of the ingredients be present in a concentration calculated from the following equation, and thereby the concentration of each ingredient in the mother solution can be maintained constant:

$$CR=C_T\times(V_1+V_2)/V_1+C_P$$

wherein $C_R$ is a concentration of each ingredient in the replenisher, $C_T$ is the concentration of that ingredient in the mother solution (processing tank solution), $C_P$ is the concentration of that ingredient consumed during the processing, $V_1$ is the volume (λ) of the replenisher having a bleaching capacity used for the processing of a 1 $m^2$ of photosensitive material, and $V_2$ is the amount (λ) of that ingredient brought into the replenisher from a prebath by the 1 $m^2$ of photosensitive material.

Further, it is desirable for the bleaching solution to contain pH buffers. In particular, low-odor dicarboxylic acids, such as succinic acid, maleic acid, malonic acid, glutaric acid, adipic acid, etc., are preferred as pH buffers. In addition, it is desirable to use known bleach accelerators described in JP-A-53-95630, *Research Disclosure*, RD No. 17129, and U.S. Pat. No. 3,893,858.

The bleaching solution is desirably replenished with from 50 to 1,000 ml of a bleach replenisher per 1 $m^2$ of photosensitive material processed therein. As for the bleach replenisher volume, the range of 80 to 500 ml, especially 100 to 300 ml, is preferred. Further, the bleaching solution is preferably subjected to aeration.

As for the processing solution having a fixability, the compounds and the processing conditions described in JP-A-04-125558, from page 7, left lower column, line 10, to page 8, right lower column, line 19, can be applied thereto.

For the purpose of improvements in fixing speed and preserving properties in particular, it is desirable to add the compounds represented by general formulae (I) and (II) in JP-A-06-301169 independently or in combination to the solution having a fixability. Also, it is desirable to use not only p-toluenesulfinic acid but also the sulfinic acids described in JP-A-01-224762 for making an improvement in preserving properties. In solutions having bleaching or/and fixing capacities, it is effective to use ammonium as cation from the standpoint of enhancement of desilvering properties. In view of the reduction of environmental pollution, however, it is preferable that the ammonium ion concentration therein be lessened or zero.

In the bleach, bleach-fix and fixation steps, it is preferred in particular to carry out the jet agitation described in JP-A-01-309059.

The replenishment rate of a replenisher used in the bleach-fix or fixation step is from 100 to 1,000 ml, preferably from 150 to 700 ml, particularly preferably from 200 to 600 ml, per $m^2$ of photosensitive material processed.

In the bleach-fix and fixation steps, it is desirable to recover silver by the in-line or off-line installation of some silver recovery apparatus. In the in-line installation, the silver ion concentration in the processing solutions can be lowered; as a result, the replenishment rate can be reduced. In the off-line installation, on the other hand, the solution remaining after silver recovery can be re-used as a replenisher.

The bleach-fix and fixation steps can be performed using a plurality of processing tanks. Therein, it is desirable to adopt a multistage counter-current method by connecting those tanks to one another by the cascade pipe arrangement. In general, the two-tank cascade structure is efficient from the viewpoint of the size balance between that processing part and the developing machine as a whole. The ratio of the processing time in the former tank to that in the latter tank is preferably from 0.5:1 to 1:0.5, and particularly preferably from 0.8:1 to 1:0.8.

In a bleach-fix bath and a fixing bath, it is desirable from the standpoint of enhancement of preserving properties that chelating agents be present in the free state without forming metal complex salts. Suitable examples of such chelating agents include the biodegradable chelating agents of which mention is already made in the description of bleaching agents.

To washing and stabilization steps, the contents described in JP-A-04-125558, from page 12, right lower column, line 6, to page 13, right lower column, line 16, are preferably applicable. In general, a stabilizing bath contains a magenta dye-stabilizing agent, typically formaldehyde. In the present invention, however, it is desirable to use the azolylmethylamines described in EP-A-0504609 and EP-A-0519190 or the N-methylolazoles described in JP-A-04-362943 in place of formaldehyde, because the effects of the present invention can be heightened thereby. Preferably, any magenta dye-stabilizing agents is not present at all in the stabilizing bath used in the present invention. The term "magenta dye-stabilizing agent" as used herein is referred to as the compounds capable of deactivating residual magenta couplers to reduce stains and discoloration of magenta dyes. Specific examples of such compounds include aldehydes such as formaldehyde, acetaldehyde, pyruvic aldehyde, m-hydroxybenzaldehyde, p-hydroxybenzaldehyde, etc., the methylol compounds and hexamethylenetetramine described in U.S. Pat. No. 4,786,583, the hexahydrotriazines described in JP-A-02-153348, formaldehyde precursors such as the formaldehyde-hydrogen sulfite adducts described in U.S. Pat. No. 4,921,779, the azolylmethylamines described in EP-A-0504609 and EP-A-0519190 and the N-methylolazoles described in JP-A-04-362943.

In view of the enhancement of the capabilities of reading magnetic information, it is especially desirable in the present invention that the bath used in the final step be free from any image stabilizers.

The washing bath and the stabilizing bath are each desirably replenished at a rate of from 80 to 1,000 ml, preferably from 100 to 500 ml, particularly preferably from 150 to 300 ml, per $m^2$ of photosensitive material processed therein. In view of both retention of the washing or stabilizing capacity and reduction in the waste solution volume for environmental preservation, it is appropriate to choose the replenishment rate from the aforementioned range. In the processing performed at such a replenishment rate, it is desirable to use known antifungals, such as thiabendazole, 1,2-benzoisothiazoline-3-one, 5-chloro-2-methylisothiazoline-3-one, etc., antibiotic such as gentamicin, or/and the water demineralized with ion exchange resins for the purpose of preventing bacteria and molds from propagating. The combined use of demineralized water and an antibacterial or antibiotic agent is more effective.

Further, it is desirable for the solution in the washing or stabilizing tank to undergo the reverse osmosis treatment as described in JP-A-03-46652, JP-A-03-53246, JP-A-03-121448 or JP-A-03-126030, thereby effecting a reduction in replenishment rate. In this case, it is preferable to adopt the low-pressure reverse osmosis.

In the processing according to the present invention, it is especially desirable for the processing solutions to undergo the evaporation correction as disclosed in Japanese Kokai Giho, Kogi (Journal of Technical Disclosure) No. 94-4992 (published by Hatsumei Kyokai). In particular, it is preferable to proceed the processing according to the equation (1), which is described at page 2 of that reference, so that water evaporation amount during stop, on stand-by and during driving of a developing machine is calculated with informations of temperature and humidity under the condition and an amount of water corresponding to the evaporated amount is supplied to each processing bath of the developing machine. The water used for evaporation correction is desirably collected from a replenishing tank for washing. In this case, the washing replenisher placed in the replenishing tank is preferably demineralized water.

As for the automatic developing machine used in the present invention, the film processors described in the above-cited Japanese Kokai Giho (Journal of Technical Disclosure), at page 3, right column, lines 2–28, are used to advantage.

Specific examples of processing chemicals, automatic developing machines and methods for evaporation correction which are favorable for embodying the present invention are described in the above-cited Japanese Kokai Giho (Journal of Technical Disclosure), from page 5, right column, line 11, to page 7, right column, end line.

Suitable examples of a photosensitive material to which the present invention is applicable include the photosensitive materials described in JP-A-04-125558, from page 14, left upper column, line 1, to page 18, left lower column, line 11. As for the silver halide emulsions, silver iodobromide emulsions having an average iodide content of 3 to 20 mole % are desirable. As for the emulsion grains, tabular emulsion grains having an aspect ratio of at least 5 and emulsion grains having two-phase structure in which the inner and outer parts are different in halide composition are preferable in particular. Additionally, the latter emulsion grains may have a distinct double-layer structure, and the aspect ratio of the former emulsion grains is preferably from 5 to 20, particularly preferably from 6 to 12.

Also, the monodisperse emulsions described in U.S. Pat. Nos. 3,574,628 and 3,655,394 are favorable.

The photosensitive materials to which the present invention is applied are preferably provided with a layer containing fine-grain light-insensitive silver halide having an average grain size of 0.02 to 0.2 λm. The fine-grain silver halide is preferably silver iodobromide having an iodide content of 0.5 to 10 mole %.

The additives used in photosensitive materials to which the present invention is applicable are summarized in the following table.

| Additives | RD 17643 | RD 18716 | RD 307105 |
|---|---|---|---|
| 1. Chemical Sensitizers | p.23 | p.648, right column | p.866 |
| 2. Sensitivity Increasing Agents | | p.648, right column | |
| 3. Spectral Sensitizers and Supersensitizers | pp.23–24 | p.648, right column, to p.649, right column | pp.866–868 |
| 4. Brightening Agents | p.24 | p.647, right column | p.868 |
| 5. Light Absorbents, Filter dyes and UV Absorbents | pp.25–26 | p.649, right column, to p.650, left column | p.873 |
| 6. Binders | p.26 | p.651, left column | pp.873–874 |
| 7. Plasticizers and Lubricants | p.27 | p.650, right column | p.876 |
| 8. Coating Aids and Surfactants | pp.26–27 | p.650, right column | pp.875–876 |
| 9. Antistatic Agents | p.27 | p.650, right column | pp.876–877 |
| 10. Matting agents | | | pp.878–879 |

Various kinds of dye-forming couplers can be used in the photosensitive materials to which the present invention is applicable. In particular, the following couplers are used to advantage.

Yellow Couplers:

The couplers represented by formulae (I) and (II) in EP-A-0502424; the couplers represented by formula (1) and (2) in EP-A-0513496 (especially Coupler Y-28 at page 18); the couplers represented by formula (I) in claim 1 of EP-A-0568037; the couplers represented by general formula (I) in U.S. Pat. No. 5,066,576, column 1, lines 45–55; the couplers represented by general formula (I) in JP-A-04-274425, paragraph [0008]; the couplers described in claim 1 of EP-A-0498381, page 40 (especially Coupler D-35 at page 18); the couplers represented by formula (Y) in EP-A1-0447969, page 4 (especially Coupler Y-1 (page 17) and Coupler Y-54 (page 41)); and the couplers represented by formulae (II) to (IV) in U.S. Pat. No. 4,476,219, column 7, lines 36–58 (especially Couplers II-17 and II-19 (column 17) and Coupler II-24 (column 19)).

Magenta Couplers:

The couplers of JP-A-03-39737, specifically Coupler L-57 (page 11, right lower column), Coupler L-68 (page 12, right lower column) and Coupler L-77 (page 13, right lower column); the couplers of European Patent 456,257, specifically Coupler [A-4]-63 (page 134) and Couplers [A-4]-73 and [A-4]-75 (page 135); the couplers of European Patent 486,965, specifically Couplers M-4 and M-6 (page 26) and Coupler M-7 (page 27); the coupler of EP-A-0571959, specifically Coupler M-45 (page 19); the coupler of JP-A-05-204106, specifically Coupler M-1 (page 6); and the coupler of JP-A-04-362631, specifically Coupler M-22 (paragraph [0237]).

Cyan Couplers:

The couplers of JP-A-04-204843, specifically Couplers CX-1, CX-3, CX-4, CX-5, CX-11, CX-12, CX-14 and CX-15 (pages 14-16); the couplers of JP-A-04-43345, specifically Couplers C-7 and C-10 (page 35), Couplers C-34 and C-35 (page 37), and Couplers (I-1) and (I-17) (pages 42–43); and the couplers represented by general formula (Ia) and (Ib) in claim 1 of JP-A-06-67385.

Polymer Couplers:

The couplers of JP-A-02-44345, specifically Couplers P-1 and P-5 (page 11).

As for the coupler of the type which can form a dye having moderate diffusibility, the couplers described in U.S. Pat. No. 4,366,237, GB Patent 2,125,570, EP-B-0096873 and DE Patent 3,234,533 are suitable examples thereof.

Suitable examples of couplers for compensating unnecessary absorption of dyes formed by color development include the yellow colored cyan couplers represented by formulae (CI), (CII), (CIII) and (CIV) in EP-A1-0456257, page 5 (especially Coupler YC-86 at page 84); the yellow colored magenta couplers described in that EP patent, specifically Coupler ExM-7 (page 202), Couplers EX-1 (page 249) and EX-7 (page 251); the magenta colored cyan couplers described in U.S. Pat. No. 4,837,136, specifically Couplers CC-9 (column 8) and CC-13 (column 10); Coupler (2) of U.S. Pat. No. 4,837,136, column 8; and the colorless masking couplers represented by formula (A) in claim 1 of WO 92/11575 (especially the compounds exemplified at pages 36–45).

The present invention will now be illustrated in more detail by reference to the following examples, but it should be understood that these examples are not to be construed as limiting the scope of the invention in any way.

EXAMPLE 1

Liquid color developers No. 1 to No. 16 were prepared using the ingredients in their respective proportions set forth in Tables 1 to 3. Each of these liquid color developers was charged into a cylindrical Vessel D, which is shown in Table 4, having an inner volume of 540 ml at a void rate of 0.08 (namely the volume of each liquid developer charged was 497 ml), and the vessel was sealed up with a 3 mm-thick polypropylene cap. These vessels were stored for 12 months in a thermo-hygrostated room of 30° C.–70% RH. Thereafter, the sodium sulfite, hydroxylamine, diethylhydroxylamine and the present compound present in each of the thus stored liquid color developers were analyzed quantitatively, and thereby the remaining rates of these ingredients were determined. The results obtained are shown in Table 5. Additionally, the determination of each ingredient was made by high-speed liquid chromatography.

TABLE 1

| Color Developer No. | 1 | 2 | 3 | 4 | 5 | 6 |
|---|---|---|---|---|---|---|
| Hydroxylamine Sulfate | 3.4 g | 3.4 g | — | — | — | — |
| Diethylhydroxylamine | — | — | 3.7 g | 3.7 g | — | — |
| Present Compound (formula (I)) | — | — | — | — | (6) 0.04 mole | (6) 0.04 mole |
| Diethylenetriamine-pentaacetic Acid | 2.8 g | 2.8 g | 2.8 g | 2.8 g | 2.8 g | 2.8 g |
| Potassium Hydroxide | 1.8 g | 1.8 g | 1.8 g | 1.8 g | 1.8 g | 1.8 g |
| Sodium Sulfite | 5.3 g | 5.3 g | 5.3 g | 5.3 g | 5.3 g | 5.3 g |
| Potassium Bromide | 0.4 g | 0.4 g | 0.4 g | 0.4 g | 0,4 g | 0.4 g |
| Tiron | 0.3 g | 0.3 g | 0.3 g | 0.3 g | 0.3 g | 0.3 g |
| Color Developing Agent*1) | 6.5 g | 6.5 g | 6.5 g | 6.5 g | 6.5 g | 6.5 g |
| Potassium Carbonate | 39.0 g | 39.0 g | 39.0 g | 39.0 g | 39.0 g | 39.0 g |
| Diethylene Glycol | — | — | — | — | — | — |
| Sodium p-Toluene-sulfonate | — | — | — | — | — | — |
| Saccharose | — | — | — | — | — | — |
| Water to make | 1000 ml | 500 ml | 1000 ml | 500 ml | 1000 ml | 1000 ml |
| pH adjusted to*2) | 10.18 | 10.20 | 10.18 | 10.20 | 10.18 | 10.18 |
| Specific Gravity | 1.043 | 1.086 | 1.043 | 1.085 | 1.046 | 1.050 |
| Remark | comparison | comparison | comparison | comparison | comparison | invention |

*1)4-[N-ethyl-N-(β-hydroxyethyl)]amino-2-methylaniline sulfate.
*2)with sulfuric acid and potassium hydroxide.

TABLE 2

| Color Developer No. | 7 | 8 | 9 | 10 | 11 | 12 |
|---|---|---|---|---|---|---|
| Hydroxylamine Sulfate | — | — | — | — | — | — |
| Diethylhydroxylamine | — | — | — | — | — | — |
| Present Compound (formula (I)) | (6) 0.04 mole | (6) 0.04 mole | (6) 0.04 mole | (6) 0.04 mole | (6) 0.04 mole | (6) 0.04 mole |
| Diethylenetriamine-pentaacetic Acid | 2.8 g | 2.8 g | 2.8 g | 2.8 g | 2.8 g | 5.6 g |
| Potassium Hydroxide | 1.8 g | 1.8 g | 1.8 g | 1.8 g | 1.8 g | 1.8 g |
| Sodium Sulfite | 5.3 g | 5.3 g | 5.3 g | 5.3 g | 5.3 g | 5.3 g |
| Potassium Bromide | 0.4 g | 0.4 g | 0.4 g | 0.4 g | 0.4 g | 0.4 g |
| Tiron | 0.3 g | 0.3 g | 0.3 g | 0.3 g | 0.3 g | 0.3 g |
| Color Developing Agent | 6.5 g | 6.5 g | 6.5 g | 6.5 g | 6.5 g | 6.5 g |
| Potassium Carbonate | 39.0 g | 39.0 g | 39.0 g | 39.0 g | 39.0 g | 56.0 g |
| Diethylene Glycol | — | — | — | — | — | 10.0 g |
| Sodium p-Toluene-sulfonate | — | — | — | 16.0 g | 10.0 g | 20.0 g |
| Saccharose | — | — | — | — | 10.0 g | 20.0 g |
| Water to make | 750 ml | 500 ml | 470 ml | 430 ml | 410 ml | 1000 ml |
| pH adjusted to | 10.19 | 10.20 | 10.20 | 10.20 | 10.20 | 10.18 |
| Specific Gravity | 1.061 | 1.093 | 1.100 | 1.120 | 1.130 | 1.080 |
| Remark | invention | invention | invention | invention | invention | invention |

TABLE 3

| Color Developer No. | 13 | 14 | 15 | 16 |
|---|---|---|---|---|
| Hydroxylamine Sulfate | 1.7 g | — | — | — |
| Diethylhydroxylamine | — | — | — | — |
| Present Compound (formula (I)) | (6) 0.04 mole | (6) 0.04 mole | (2) 0.04 mole | (16) 0.04 mole |

TABLE 3-continued

| Color Developer No. | 13 | 14 | 15 | 16 |
|---|---|---|---|---|
| Diethylenetriamine-pentaacetic Acid | 2.8 g | 2.8 g | 2.8 g | 2.8 g |
| Potassium Hydroxide | 1.8 g | 1.8 g | 1.8 g | 1.8 g |
| Sodium Sulfite | 5.3 g | 5.3 g | 5.3 g | 5.3 g |
| Potassium Bromide | 0.4 g | 0.4 g | 0,4 g | 0.4 g |

TABLE 3-continued

| Color Developer No. | 13 | 14 | 15 | 16 |
|---|---|---|---|---|
| Tiron | 0.3 g | 0.3 g | 0.3 g | 0.3 g |
| Color Developing Agent | 6.5 g | 6.5 g | 6.5 g | 6.5 g |
| Potassium Carbonate | 39.0 g | 39.0 g | 39.0 g | 39.0 g |
| Diethylene Glycol | — | — | — | — |
| Sodium p-Toluene-sulfonate | — | 10.0 g | — | — |
| Saccharose | — | 10.0 g | — | — |
| Water to make | 500 ml | 395 ml | 500 ml | 500 ml |
| pH adjusted to | 10.20 | 10.20 | 10.20 | 10.20 |
| Specific Gravity | 1.086 | 1.135 | 1.084 | 1.085 |
| Remark | invention | comparison | invention | invention |

TABLE 4

| Vessel | Material | Thickness [μm] | Inner Volume [ml] | $CO_2$ Permeating Speed [ml/(m$^2$ · 24 hrs · atm)] |
|---|---|---|---|---|
| A | High-Density Polyethylene | 1,000 | 540 | 230 |
| B | Polyvinyl Chloride | 500 | 550 | 28 |
| C | Polyethylene Terephthalate | 500 | 550 | 16 |
| D | Laminate | | 540 | 13 |
| | Outer Layer: High-Density Polyethylene | 250 | | |
| | Inner Layer: Biaxially Stretched Nylon | 120 | | |
| | Outer Layer: High-Density Polyethylene | 250 | | |

TABLE 5 (1)

| Color Developer No. | 1 | 2 | 3 | 4 | 5 | 6 |
|---|---|---|---|---|---|---|
| Vessel | D | D | D | D | D | D |
| Void Rate | 0.08 | 0.08 | 0.08 | 0.08 | 0.08 | 0.08 |
| Remaining Rate (%) | | | | | | |
| Sodium Sulfite | 43.7 | 41.0 | 79.5 | 76.5 | 74.4 | 87.0 |
| Hydroxylamine Sulfate | 36.2 | 34.1 | — | — | — | — |
| Diethylhydroxylamine | — | — | 70.3 | 68.2 | — | — |
| Present Compound (formula (I)) | — | — | — | — | 81.5 | 87.7 |
| Remark | comparison | comparison | comparison | comparison | comparison | invention |

TABLE 5 (2)

| Color Developer No. | 7 | 8 | 9 | 10 | 11 | 12 |
|---|---|---|---|---|---|---|
| Vessel | D | D | D | D | D | D |
| Void Rate | 0.08 | 0.08 | 0.08 | 0.08 | 0.08 | 0.08 |
| Remaining Rate (%) | | | | | | |
| Sodium Sulfite | 91.3 | 96.2 | 95.8 | 92.0 | 87.3 | 95.2 |
| Hydroxylamine Sulfate | — | — | — | — | — | — |
| Diethylhydroxylamine- | — | — | — | — | — | — |
| Present Compound | 90.5 | 93.5 | 93.0 | 91.5 | 88.8 | 92.8 |
| Remark | invention | invention | invention | invention | invention | invention |

TABLE 5 (3)

| Color Developer No. | 13 | 14 | 15 | 16 |
|---|---|---|---|---|
| Vessel | D | D | D | D |
| Void Rate | 0.08 | 0.08 | 0.08 | 0.08 |
| Remaining Rate (%) | | | | |
| Sodium Sulfite | 95.1 | 81.4 | 95.5 | 95.0 |
| Hydroxylamine Sulfate | | — | — | — |
| Diethylhydroxylamine | — | — | — | — |
| Present Compound | 92.6 | 82.3 | 93.0 | 91.8 |
| Remark | invention | comparison | invention | invention |

As shown in Table 5, the sodium sulfite and hydroxylamine concentrations in the liquid Color Developers Nos. 1 and 2, wherein hydroxylamine was used, were reduced to one-half or more their respective initial values during the storage period of 12 months. Further, in the liquid Color Developers Nos. 3 and 4, wherein diethylhydroxylamine was used, the residual rates of sodium sulfite and diethylhydroxylamine were each increased, compared with the cases where hydroxylamine was used, but the concentrations thereof after the storage were reduced to 80% or less of their respective initial values, and so the resulting developers were greatly different in composition from fresh ones.

Furthermore, the stability of the liquid Color Developers Nos. 5 and 14, which each used the present compound but had specific gravity beyond the limits defined by the present invention, was no more than almost equal to that of the liquid color developers using diethylhydroxylamine.

On the other hand, the present liquid color developers, which had specific gravity adjusted within the range of 1.05 to 1.13, showed marked improvements in residual rates of sodium sulfite and the present compound, respectively. Of these liquid color developers, those having specific gravity within the range of 1.06 to 1.12 (Color Developers Nos. 7 to 10, 12, 13, 15 and 16) were higher in residual rates, and those having specific gravity within the range of 1.08 to 1.10 (Color Developers Nos. 8, 9, 12, 13, 15 and 16) showed much higher residual rates, namely excellent storage stability.

EXAMPLE 2

Color developing solutions, and color developer replenishers as well, were prepared using the liquid Color Developers Nos. 1 to 16 respectively, which were the same ones as prepared in Example 1, after 12-month storage under the condition of 30° C.-70% RH. These processing solutions were used for processing the following silver halide color photosensitive material provided with a magnetic recording layer, and examined on their influences upon photographic properties and readability of magnetic information.

1. Preparation of Color Developing Solutions:

The liquid Color Developers Nos. 1 to 16 after the 12-month storage were diluted at their respective dilution rates described below, and thereto the following starter was added to prepare color developing solutions (tank solutions) respectively. Similarly, their respective control solutions were prepared using the freshly prepared liquid Color Developers Nos. 1 to 16 respectively.

(i) Each of the liquid color developers was withdrawn in the volume calculated by the following expression;

750×(total volume of prepared liquid shown in Tables 1–3)/1000 (ml)

(ii) The withdrawn developer was diluted with water so as to make the volume of the resulting dilution 950 ml.

(iii) 50 ml of a starter having the following composition was admixed with the dilution;

| | |
|---|---|
| Sodium hydroxide | 0.117 g |
| 5-Hydroxy-7-methyl-1,2,4-triazaindolizine | 0.05 g |
| Diethylenetriaminepentaacetic acid | 0.20 g |
| Potassium carbonate | 3.14 g |
| Sodium hydrogen carbonate | 1.075 g |
| Potassium bromide | 1.075 g |
| Potassium iodide | 0.0013 g |
| Water to make | 50.0 ml |

(iv) The pH of the resulting admixture was adjusted to 10.05.

Further, the color developer replenishers were prepared by diluting the aforementioned liquid color developers at the following dilution rates respectively.

(i) Each of the liquid color developers was withdrawn in the volume calculated by the following expression;

1000×(total volume of prepared liquid shown in Tables 1–3)/1000 (ml)

(ii) The withdrawn developer was diluted with water so as to make the volume of the resulting dilution 1000 ml.

(iii) The pH of the dilution was adjusted to 10.18.

2. Preparation of Other Processing Solutions:

| | Tank Solution | Replenisher |
|---|---|---|
| [Bleaching Solution] | | |
| Ammonium Iron(III) 1,3-diaminopropanetetraacetate monohydrate | 113 g | 170 g |
| Ammonium bromide | 70 g | 105 g |
| Ammonium nitrate | 14 g | 21 g |
| Succinic acid | 34 g | 51 g |
| Maleic acid | 28 g | 42 g |
| Water to make | 1 l | 1 l |
| pH adjusted (with aqueous ammonia) to | 4.6 | 4.0 |
| [Fixing Solution] | | |
| Water solution of ammonium thiosulfate (750 g/l) | 240 ml | 720 ml |
| Imidazole | 7 g | 21 g |
| Ammonium methanesulfonate | 5 g | 15 g |
| Ammonium methanesulfinate | 10 g | 30 g |
| Ethylenediaminetetraacetic acid | 13 g | 39 g |
| Water to make | 1 l | 1 l |
| pH adjusted (with aqueous ammonia and acetic acid) to | 7.4 | 7.45 |
| [Rinsing Solution (common to tank solution and replenisher)] | | |
| Demineralized water | | 1 l |
| Sodium dichloroisocyanurate | | 0.01 g |
| Sodium sulfate | | 0.15 g |
| pH adjusted to | | 6–8 |
| [Stabilizing Solution (common to tank solution and replenisher)] | | |
| Sodium p-toluenesulfinate | | 0.03 g |
| Polyoxyethylene-p-monononylphenyl ether (average polymerization degree: 10) | | 0.2 g |

-continued

| | |
|---|---|
| 1,2-Benzoisothiazoline-3-one | 0.05 g |
| 1,2,4-Triazole | 1.3 g |
| 1,4-Bis(1,2,4-triazole-1-ylmethyl)piperazine | 0.75 g |
| Water to make | 1 l |
| pH | 7–8.5 |

3. Automatic Developing Machine and Processing Steps:

As for the automatic developing machine, an automatic developing machine for color negative films, Film Processor FP-360B. AL, a product of Fuji Photo Film Co., Ltd., was used, and the photographic processing was carried out in accordance with the following processing steps.

| Processing Step | Time | Temperature | Amount replenished |
|---|---|---|---|
| Color development | 3'05" | 38° C. | 20 ml |
| Bleach | 50" | 38° C. | 5 ml |
| Fixation (1) | 50" | 38° C. | |
| Fixation (2) | 50" | 38° C. | 8 ml |
| Washing | 20" | 38° C. | 17 ml |
| Stabilization (1) | 20" | 38° C. | |
| Stabilization (2) | 20" | 38° C. | 14 ml |
| Drying | | 55° C. | |

In the foregoing film processor, the fixation part and the stabilization part are each designed so as to have the two-tank cascade structure, and all the overflow of washing water is made to flow into the fixation tank (2).

4. Photosensitive Material:

1) Preparation of Support

The support used in this example was prepared as follows: Polyethylene-2,6-naphthalate in an amount of 100 parts by weight and a ultraviolet absorbent, Tinuvin P.326 (trade name, a product of Ciba-Geigy), in an amount of 2 parts by weight were dried, molten at 300° C., and then extruded from a T-die. The thus extruded film was longitudinally stretched 3.3 times at 140° C., and further transversely stretched 3.3 times at 130° C. The film thus stretched was thermally set at 250° C. for 6 seconds to give a 90 $\mu$m-thick PEN film. Additionally, appropriate amounts of blue dyes, magenta dyes and yellow dyes (I-1, I-4, I-6, I-24, I-26, I-27 and II-5 described in Kokai Giho, Kogi No. 94-6023.) were added in advance to the PEN film. Further, the PEN film was wound onto a stainless reel having a diameter of 20 cm, and thereto the thermal history of 48-hour heating at 110° C. was given to prepare a support hard to curl.

2) Coating of Subbing Layer

On a surface of the support prepared above were subjected successively corona discharge, UV irradiation and glow discharge treatments, and then a subbing composition containing 0.1 g/m$^2$ of gelatin, 0.01 g/m$^2$ of sodium $\alpha$-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of polyamide-epichlorohydrin condensates was applied. The side of the support having the subbing layer is situated on the high-temperature side in the stretching operation (at a coverage of 10 ml/m$^2$ by means of a bar coater). The drying was performed for 6 minutes at 115° C. (the temperature in the drying zone, including all the rollers and carrying device, were regulated at 115° C.).

3) Coating of Backing Layers

An antistatic layer, a magnetic recording layer and a lubricous layer having the following compositions respectively were coated as backing layers on the other side of the foregoing support.

3-1) Coating of Antistatic Layer

A coating composition containing 0.2 g/m$^2$ of a dispersion of the fine powder of tin oxide-antimony oxide complex having an average grain size of 0.005 μm and a specific resistance of 5 Ω·cm (secondary coagulation particle se: about 0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene(polymerization degree: 10)-p-nonylphenol, and resorcin was used for coating.

3-2) Coating of Magnetic Recording Layer

A dispersion of 0.06 g/m$^2$ of Co-γ-iron oxide (which had the specific surface area of 43 m$^2$/g, the major axis of 0.14 μm, the minor axis of 0.03 μm, the saturation magnetization of 89 emu/g and the $Fe^{+2}/Fe^{+3}$ ratio of 6/94, and underwent the surface treatment using aluminum oxide and silicon oxide in the proportion of 2 weight % to the iron oxide) coated with 3-polyoxyethylene(polymerization degree: 15)-propyloxytrimethoxysilane (15 wt %) in 1.2 g/m$^2$ of diacetyl cellulose (the iron oxide was dispersed by means of an open kneader and a sand mill), and 0.3 g/m$^2$ of $C_2H_5C(CH_2OCONH{-}C_6H_3(CH_3)NCO)_3$ as hardener were coated with a bar coater. Therein, acetone, methyl ethyl ketone and cyclohexanone was used as solvent. Additionally, a matting agent constituted of silica particles (0.3 μm) and of aluminum oxide abrasive (0.15 μm) coated with 3-polyoxyethylene(polymerization degree: 15)-propyloxytrimethoxysilane (15 wt %) was added in advance to the foregoing dispersion in amounts such that their respective coverage rates might be 10 mg/m$^2$. The drying of the coat was performed for 6 minutes at 115° C. (the temperature in the drying zone, including all the rollers and carrying device, were regulated at 115° C.). The increment in the color density $D^B$ of the magnetic recording layer was about 0.1, measured with an X-light (blue filter), and the saturation magnetic moment, the coercive force and the squareness ratio of the magnetic recording layer thus formed were 4.2 emu/g, $^{7.3\times104}$ A/m and 65% respectively.

3-3) Formation of Lubricous Layer

A mixture of diacetyl cellulose (25 mg/m$^2$), $C_6H_{13}CH(OH)C_{10}H_{20}COOC_{40}H_{81}$ (Compound a, 6 mg/m$^2$) and $C_{50}H_{101}O(CH_2CH_2O)_{16}H$ (Compound b, 9 mg/m$^2$) was coated. The mixture was coated after Compounds a and b were molten at 105° C. in a xylene/propylene monomethyl ether (1/1) mixture, poured into ordinary-temperature propylene monomethyl ether (10 times by volume), further dispersed into acetone to prepare a dispersion (average particle size: 0.01 μm). As a matting agent, silica particles (0.3 μm) and aluminum oxide abrasive (0.15 μm) coated with 3-polyoxyethylene(poly-merization degree: 15)-propyloxytrimethoxysilane (15 wt %) were coated in amounts such that their respective coverage rates might be 15 mg/$^2$. The drying of the coat was performed for 6 minutes at 115° C. (the temperature in the drying zone, including all the rollers and carrying device, were regulated at 115° C.). The thus formed lubricous layer had a kinematic friction coefficient of 0.06 (5 mm ϕ stainless ball; load=100 g; speed=6 cm/min) and a static friction coefficient of 0.07 (Clip method). Further, the kinematic friction coefficient of this lubricous layer against an emulsion layer as described below was 0.12. That is, the lubricous layer formed had excellent friction characteristics.

4) Coating of Light-Sensitive Layers

After it was coated with the foregoing backing layers, the support was further coated on the opposite side thereof with various photographic constituent layers described below to prepare a multilayer color negative film.

[Compositions of Constituent Layers]

Main ingredients used in each constituent layer are symbolized as follows:

| | | | |
|---|---|---|---|
| ExC | Cyan coupler | UV | Ultraviolet absorbent |
| ExM | Magenta coupler | HBS | High boiling solvent |
| ExY | Yellow coupler | H | Gelatin hardener |
| ExS | Sensitizing dye | | |

Each figure on the right side designates the coverage (g/m$^2$) of the ingredient corresponding thereto. As for the silver halide emulsion, the figure represents the coverage based on silver. As for the sensitizing dye, on the other hand, the figure represents the coverage expressed in mole per mole of silver present in the same layer.

| | |
|---|---|
| First Layer (antihalation layer): | |
| Black colloidal silver | silver 0.09 |
| Gelatin | 1.60 |
| ExM-1 | 0.12 |
| ExF-1 | $2.0 \times 10^{-3}$ |
| Solid disperse dye ExF-2 | 0.030 |
| Solid disperse dye ExF-3 | 0.040 |
| HBS-1 | 0.15 |
| HBS-2 | 0.02 |
| Second Layer (interlayer) | |
| Silver iodobromide emulsion M | silver 0.065 |
| ExC-2 | 0.04 |
| Polyethylacrylate latex | 0.20 |
| Gelatin | 1.04 |
| Third Layer (low speed red-sensitive emulsion layer) | |
| Silver iodobromide emulsion A | silver 0.25 |
| Silver iodobromide emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth Layer (medium speed red-sensitive emulsion layer) | |
| Silver iodobromide emulsion C | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Fifth Layer (high speed red-sensitive emulsion layer) | |
| Silver iodobromide emulsion D | silver 1.40 |
| ExS-1 | $2.4 \times 10^{-4}$ |
| ExS-2 | $1.0 \times 10^{-4}$ |

-continued

| | | |
|---|---|---|
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| Sixth Layer (interlayer) | | |
| Cpd-1 | | 0.090 |
| Solid disperse dye ExF-4 | | 0.030 |
| HBS-1 | | 0.050 |
| Polyethylacrylate latex | | 0.15 |
| Gelatin | | 1.10 |
| Seventh Layer (low speed green-sensitive emulsion layer) | | |
| Silver iodobromide emulsion E | silver | 0.15 |
| Silver iodobromide emulsion F | silver | 0.10 |
| Silver iodobromide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth Layer (medium speed green-sensitive emulsion layer) | | |
| Silver iodobromide emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| Ninth Layer (high speed green-sensitive emulsion layer) | | |
| Silver iodobromide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| Tenth Layer (yellow filter layer) | | |
| Yellow colloidal silver | silver | 0.015 |

-continued

| | | |
|---|---|---|
| Cpd-1 | | 0.16 |
| ExM-1 | | 0.12 |
| Solid disperse dye ExF-5 | | 0.060 |
| Solid disperse dye ExF-6 | | 0.060 |
| Oil-soluble dye ExF-7 | | 0.010 |
| HBS-1 | | 0.60 |
| Gelatin | | 0.60 |
| Eleventh Layer (low speed blue-sensitive emulsion layer) | | |
| Silver iodobromide emulsion J | silver | 0.09 |
| Silver iodobromide emulsion K | silver | 0.09 |
| ExS-7 | | $8.6 \times 10^{-4}$ |
| ExS-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| Twelfth Layer (high speed blue-sensitive emulsion layer) | | |
| Silver iodobromide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| Thirteenth Layer (first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| Fourteenth Layer (second protective layer) | | |
| Silver iodobromide emulsion M | silver | 0.10 |
| H-1 | | 0.40 |
| B-1 (diameter: 1.7 $\mu$m) | | $5.0 \times 10^{-2}$ |
| B-2 (diameter: 1.7 $\mu$m) | | 0.15 |
| B-3 | | 0.05 |
| S-1 | | 0.20 |
| Gelatin | | 0.70 |

In addition, W-1 to W-3, B-4 to B-6, F-1 to F-17, and iron, lead, gold, platinum, palladium, iridium and rhodium salts were properly added to each constituent layer for the purposes of making improvements in keeping quality, processability, pressure resistance, antimold and antibacterial properties, antistatic properties and coatability.

The features of the emulsions used are summarized in Table 6.

TABLE 6

| Emulsion | Average AgI content (%) | Variation coefficient (%) with respect to AgI content in grains | Average grain size (corresp. to diameter of sphere (μm)) | Variation coefficient (%) with respect to grain size distribution | Projected area diameter* (μm) | Diameter/thickness ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

*referring to the diameter of the circle having the same area as the projected area of the grain Making additional remarks about the emulsions set forth in Table 6:

(1) In accordance with the embodiments described in Examples of JP-A-02-191938, the emulsions J to L underwent reduction sensitization with thiourea dioxide and thiosulfonic acid upon grain formation.

(2) In accordance with the embodiments described in Examples of JP-A-03-237450, the emulsions A to H underwent gold sensitization, sulfur sensitization and selenium sensitization in the presence of the spectral sensitizing dyes used for their respective sensitive layers and sodium thiocyanide.

(3) In the preparation of tabular grains, low molecular weight gelatin was used, as in the Examples of JP-A-01-158426.

(4) According to the observation with a high tension electron microscope, the dislocation lines as described in JP-A-03-237450 were observed in the tabular grains.

(5) The grains present in the emulsion L were those having the double-layer (core/shell) structure having a high iodide content in the core part, as described in JP-A-60-143331.

Preparation of Dispersions of Solid Organic Disperse Dyes

A solid disperse dye ExF-2 illustrated below was dispersed in the following manner: In a 700-ml pot mill were placed 21.7 ml of water, 3 ml of a 5% water solution of sodium p-octylphenoxyethoxyethoxyethanesulfonate and 0.5 g of a 5% water solution of p-octylphenoxypolyoxyethylene ether (polymerization degree: 10). Thereto, 5.0 g of ExF-2 and 500 ml of zirconium oxide beads were added. The contents were subjected to a 2-hour dispersing operation. In the dispersion operation, a BO-type vibration ball mill made by Chuo Koki Co., Ltd. was used. After the dispersion, the contents were taken out of the ball mill, added to 8 g of a 12.5% water solution of gelatin, and therefrom the beads were removed by filtration to prepare the dispersion of dye in gelatin. The thus finely divided dye had an average particle size of 0.44 μm.

In analogy with ExF-2, solid dispersions of ExF-3, ExF-4 and ExF-6 were prepared. Fine particles of these dyes had average sizes of 0.24 μm, 0.45 μm and 0.52 μm respectively. The dye ExF-5 was dispersed using the microprecipitation method described in Example 1 of EP-A-0549489. The average particle size of this dispersion was 0.06 μm.

The structural formulae of the compounds used in the photosensitive material are illustrated below:

ExC-1

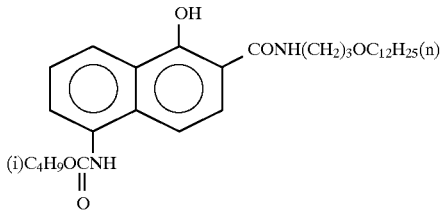

ExC-2

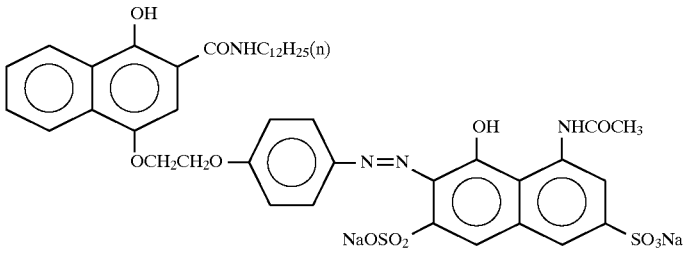

-continued
ExC-3
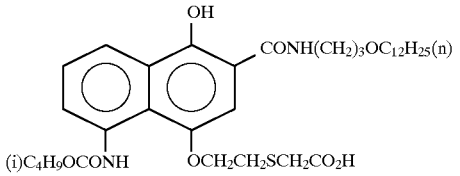
ExC-4
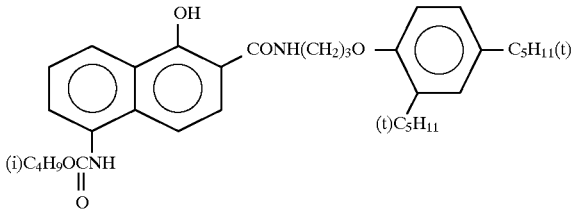
ExC-5
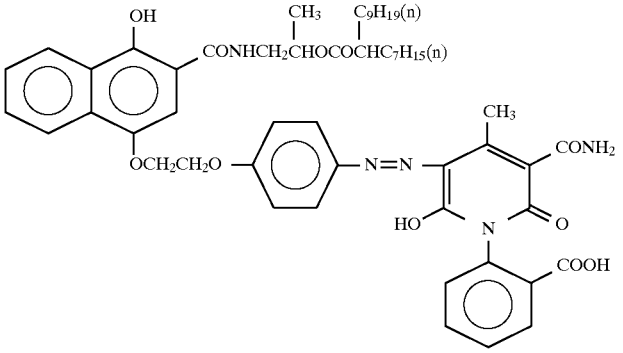
ExC-6
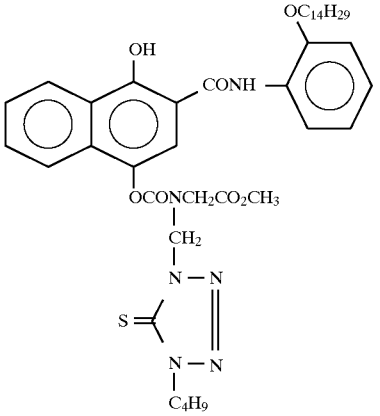
ExC-7
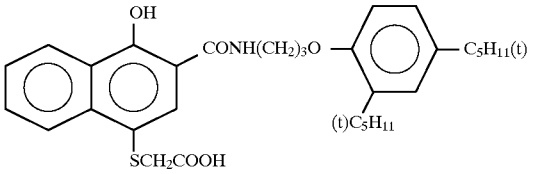

-continued
ExC-8
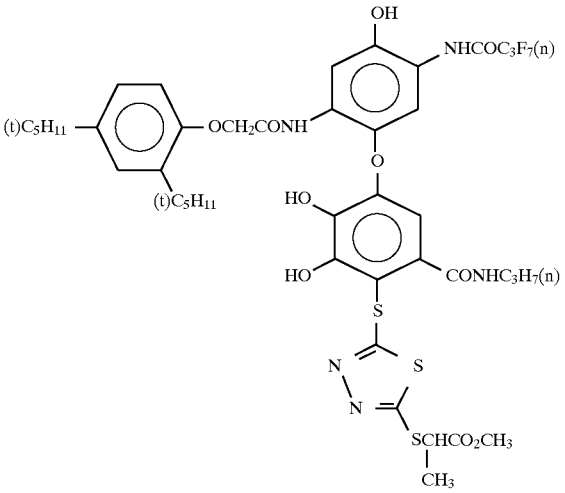
ExM-1
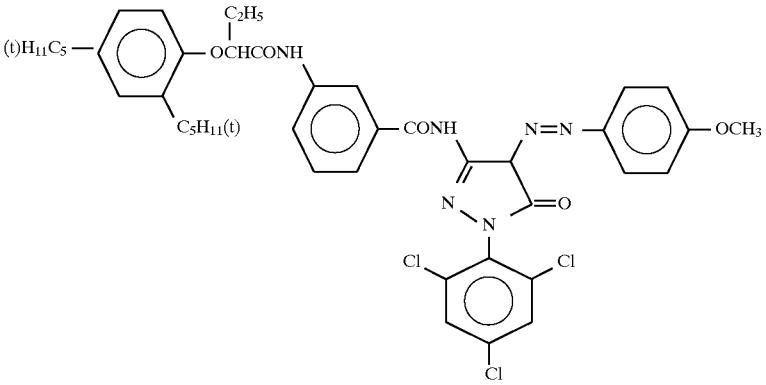
ExM-2
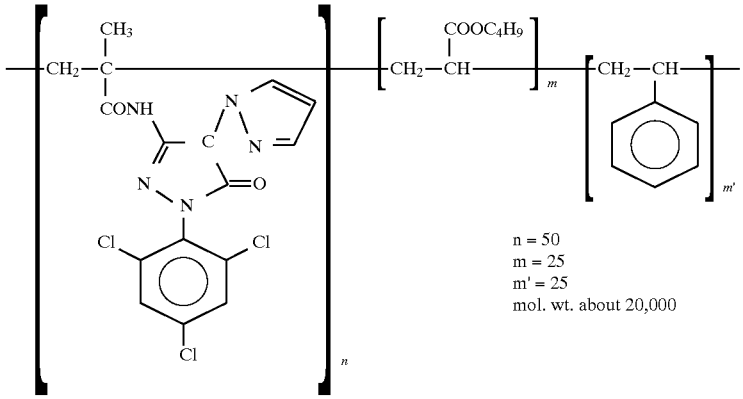
ExM-3
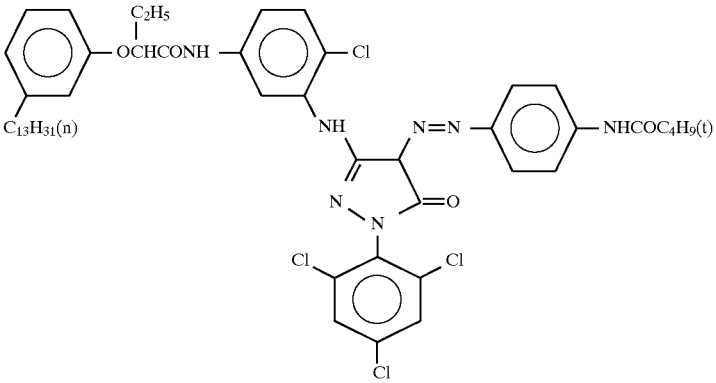

-continued
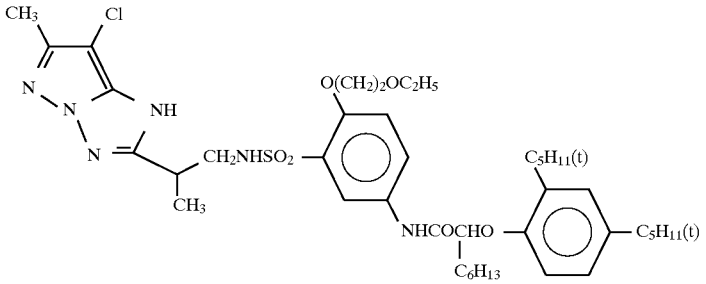
ExM-5
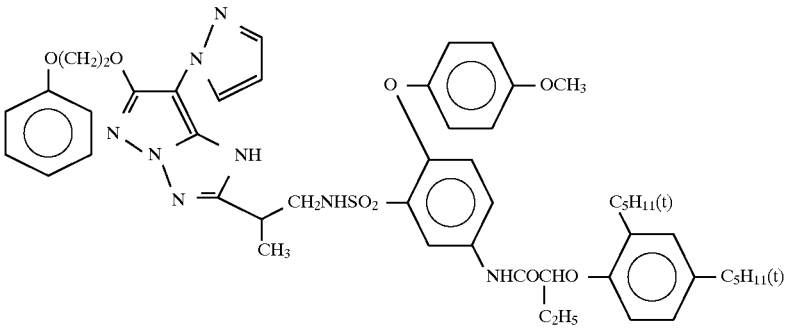
ExY-1
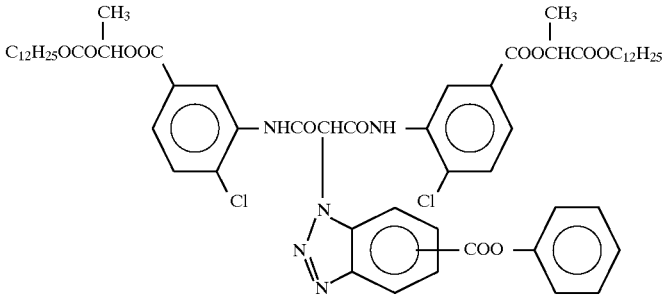
ExY-2
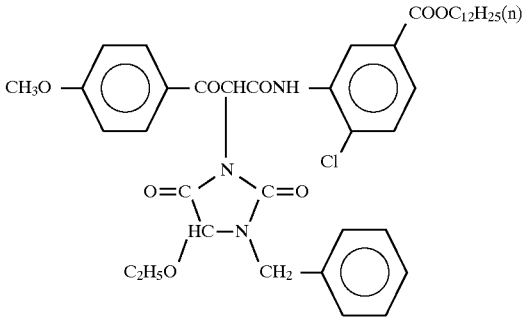
ExY-3
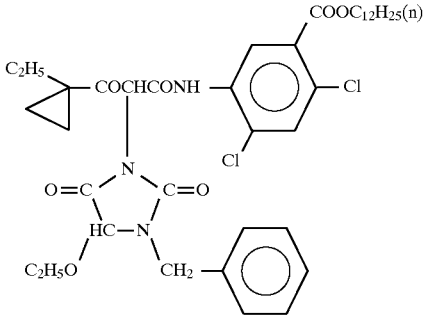

-continued
ExY-4
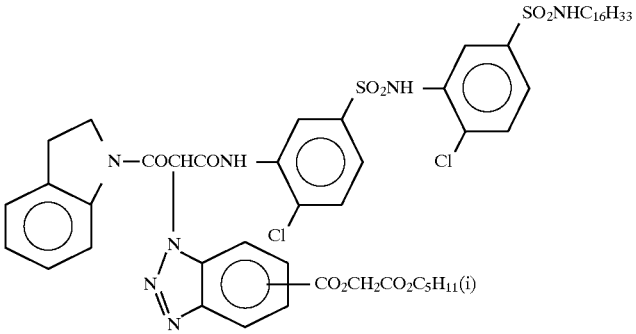
ExY-5
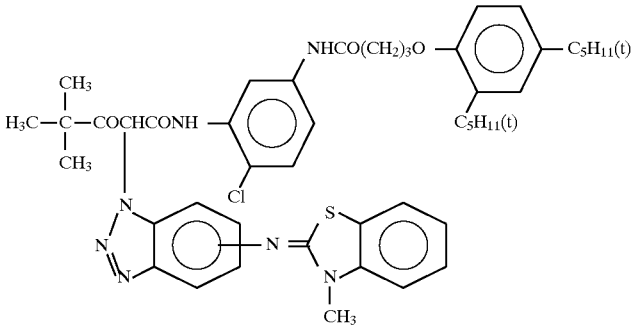
ExF-1
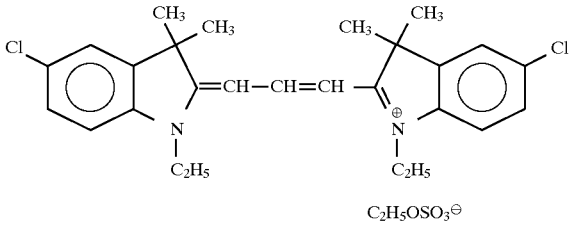
ExF-2
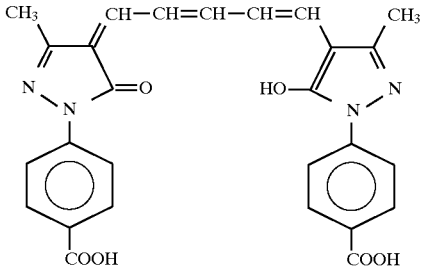
ExF-3
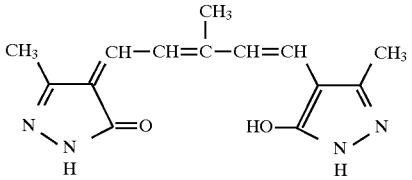
ExF-4
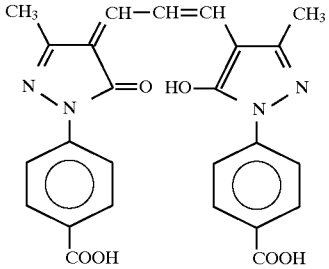

-continued
ExF-5
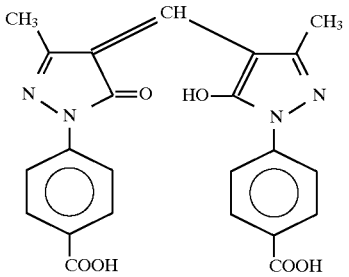
ExF-6
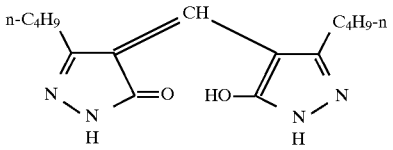
ExF-7
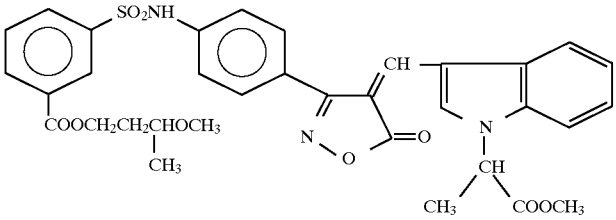
Cpd-1
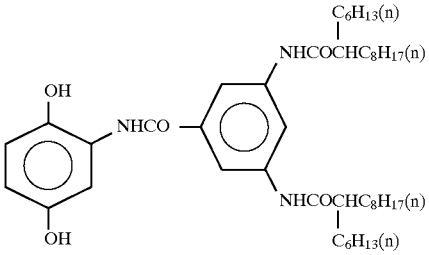
Cpd-2
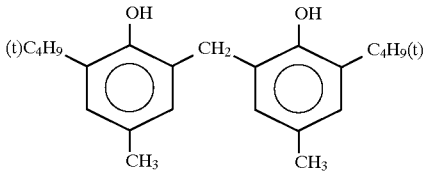
Cpd-3
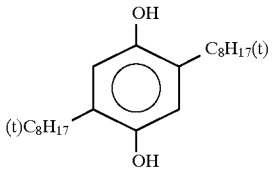
UV-1
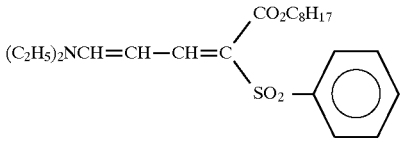
UV-2
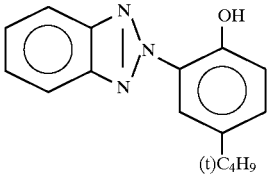

-continued
UV-3
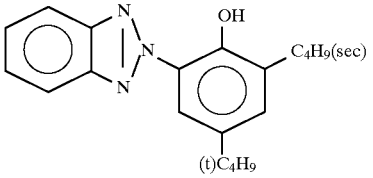
tricresylphosphate HBS-1
di-n-butylphthalate HBS-2
HSB-3
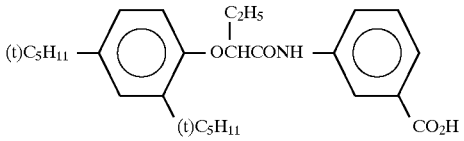
tri(2-ethylhexyl)phosphate HBS-4
ExS-1
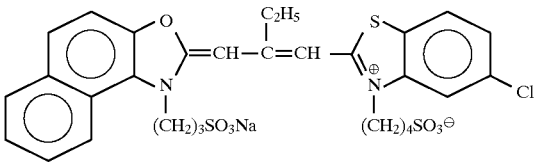
ExS-2
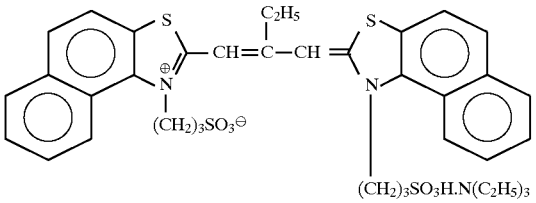
ExS-3
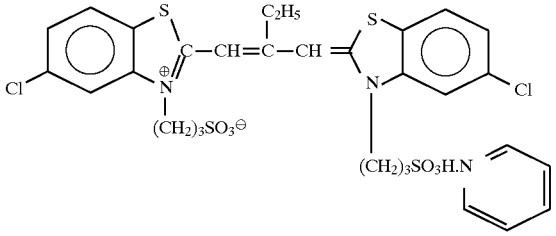
ExS-4
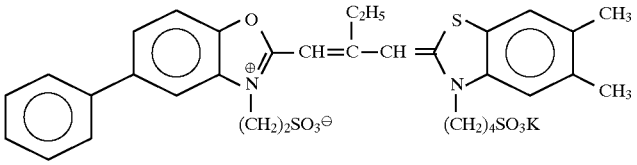
ExS-5
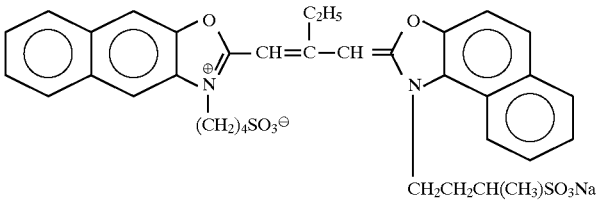
ExS-6
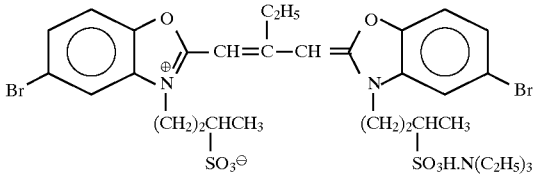

-continued
ExS-7
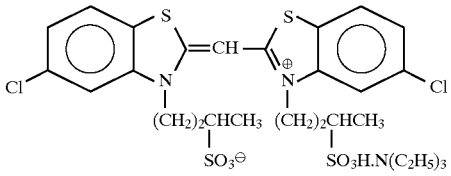
S-1
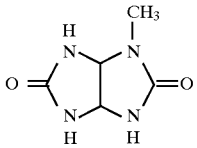
H-1
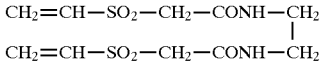
B-1
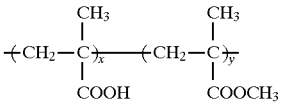
x/y = 10/90 (weight %)
average molecular weight:
about 35,000
B-2
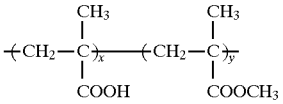
x/y = 40/60 (weight %)
average molecular weight:
about 20,000
B-3
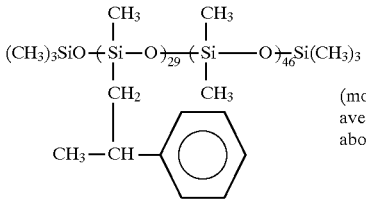
(mole %)
average molecular weight:
about 8,000
B-4
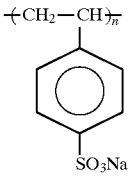
average molecular weight:
about 750,000
B-5
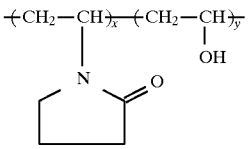
x/y = 70/30 (weight %)
average molecular weight:
about 17,000
B-6
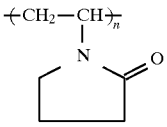
average molecular weight:
about 10,000
W-1
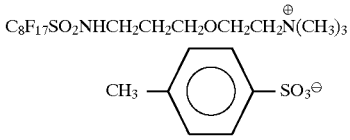
W-2
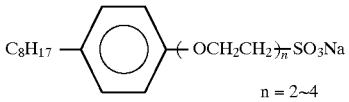
n = 2~4

-continued
W-3
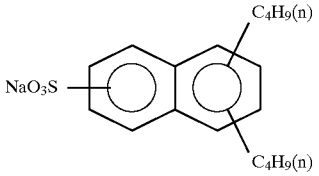
F-1
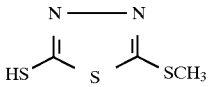
F-2
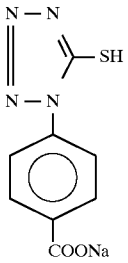
F-3
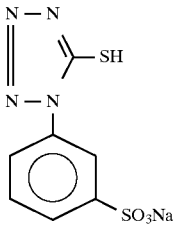
F-4
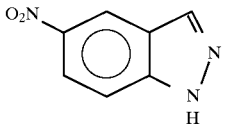
F-5
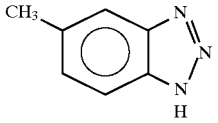
F-6
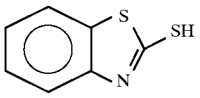
F-7
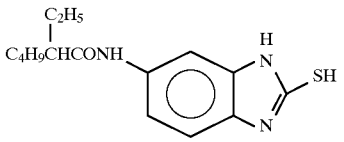
F-8
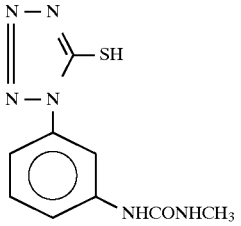
F-9
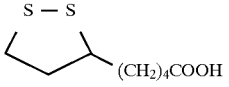

-continued

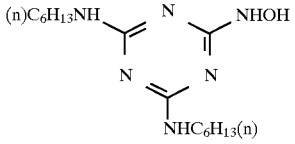

F-10

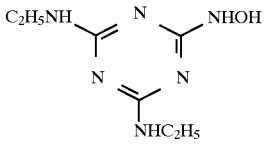

F-11

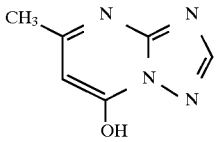

F-12

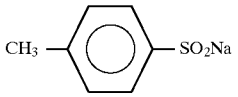

F-13

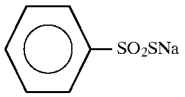

F-14

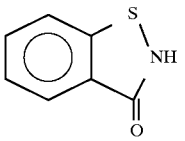

F-15

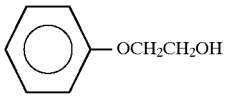

F-16

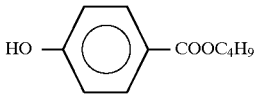

F-17

The thus prepared photosensitive material was cut into strips, 24 mm wide and 160 cm long. Each strip was first perforated with two 2mm square holes at 5.8-mm intervals in the length direction at the position 0.7 mm away from the one longitudinal edge in the width direction, and then perforated with pairs of these two holes at 32-mm intervals in the length direction. The film cartridge made of plastics, as illustrated in FIG. 1 to FIG. 7 of U.S. Pat. No. 5,296,887, was loaded with each of the thus perforated strips.

Under a proper exposure condition, photographs of a standard object were taken with a camera loaded with the aforementioned sample film. Then, on the magnetic recording layer side of the sample film, the digital saturation recording at a recording wavelength of 50 $\mu$m was performed using an audio type permalloy-made magnetic recording head under a condition that the head gap was 5 $\mu$m, the turn number was 50 and the forwarding speed was 100 mm/sec.

100 rolls of the sample film bearing with the magnetic information written above were continuously processed by means of the aforementioned automatic developing machine.

After the processing, all rolls of the sample film were continuously examined for output signal level of the isolated regenerate wave by means of a permalloy-made magnetic reproducing head having a head gap of 2.5 $\mu$m and a turn number of 2,000.

As for the results of this examination, the average output level of the first roll of the sample film was taken as 100, and the average output level of the 100th roll of the sample film was expressed in terms of the proportion (%) to that of the first roll of the sample film. The data on this proportion are shown in Table 7.

Additionally, all rolls of the sample film underwent the 10 CMS wedge exposure at the color temperature of 4,800° K. prior to the aforementioned processing, and then they were subjected to that processing and further examined for the density by means of a densitometer to obtain characteristic curves.

On these characteristic curves, Dmin and HD of the developed yellow color as defined below were determined:

Dmin: The minimum density of developed yellow color on a characteristic curve.

HD: The developed yellow color density corresponding to the exposure point obtained by adding 2.0, expressed in logarithmic scale, log E, to the exposure point corresponding to the density of (Dmin +0.2).

Similarly to the processing with the developing solutions prepared from the stored liquid color developers, the processing with their respective control solutions (prepared from fresh ones) was carried out to obtain the data on Dmin and HD. The differences in Dmin and HD respectively between these two cases of processing were shown in Table 7.

TABLE 7 (1)

| Color Developer No. | 1 | 2 | 3 | 4 | 5 | 6 |
|---|---|---|---|---|---|---|
| Vessel | D | D | D | D | D | D |
| Void Rate | 0.08 | 0.08 | 0.08 | 0.08 | 0.08 | 0.08 |
| Output (%) | 65 | 60 | 64 | 61 | 68 | 86 |
| Difference in HU | 0.15 | 0.15 | 0.07 | 0.07 | −0.06 | −0.02 |
| Difference in Dmin | 0.05 | 0.05 | 0.02 | 0.02 | 0.02 | −0.01 |
| Remark | comparison | comparison | comparison | comparison | comparison | invention |

TABLE 7 (2)

| Color Developer No. | 7 | 8 | 9 | 10 | 11 | 12 |
|---|---|---|---|---|---|---|
| Vessel | D | D | D | D | D | D |
| Void Rate | 0.08 | 0.08 | 0.08 | 0.08 | 0.08 | 0.08 |
| Output (%) | 91 | 98 | 97 | 92 | 87 | 96 |
| Difference in HD | −0.01 | 0.00 | 0.00 | −0.02 | −0.03 | 0.00 |
| Difference in Dmin | 0.00 | 0.00 | 0.00 | 0.00 | 0.00 | 0.00 |
| Remark | invention | invention | invention | invention | invention | invention |

TABLE 5 (3)

| Color Developer No. | 13 | 14 | 15 | 16 |
|---|---|---|---|---|
| Vessel | D | D | D | D |
| Void Rate | 0.08 | 0.08 | 0.08 | 0.08 |
| Output (%) | 96 | 73 | 93 | 92 |
| Difference in HD | 0.01 | −0.04 | −0.01 | −0.01 |
| Difference in Dmin | 0.00 | 0.02 | 0.00 | 0.00 |
| Remark | invention | comparison | invention | invention |

In the continuous reading of the information magnetically recorded on 100 rolls of sample film, as shown in Table 7, the output regenerated on the 100th roll was reduced to about two-thirds that on the 1st roll in the cases where the processing was performed with the comparative Color Developers, Nos. 1 to 5. However, unless the output of the magnetically recorded information is secured in the proportion of at least 85% to its original value, errors in reading cannot be avoided.

In all the cases where the processing was performed with the present Color Developers, on the other hand, at least 86% of the original output of the magnetically recorded information was secured. In particular, 90% or more of the original output was secured in the cases where the Color Developers had specific gravity in the range 1.06 to 1.12, and a still higher regenerate output was secured in the cases where the specific gravity of Color developer was within the range 1.08 to 1.10.

As for the Dmin and HD of the developed yellow color, differences in them between the cases using the stored liquid color developer and its control solution (freshly prepared one) were significantly smaller in the processing with the present liquid color developers than in the processing with the comparative ones. Thus, these experimental results prove that the present liquid color developers can ensure satisfactory photographic properties even after long-term storage.

EXAMPLE 3

The vessels A, B, C and D shown in Table 4 were each charged with the liquid Color Developer No. 1, No. 8 or No. 15 set forth in Tables 1, 2 and 3 respectively at different void rates, and stored for 12 months under the same condition as in Example 1. Then, the sodium sulfite, the hydroxylamine and the present compound remaining in each of the stored developers were determined by high-speed liquid chromatography, and the remaining rates of those ingredients were calculated by comparison with their concentrations in the corresponding fresh developer.

In analogy with Example 2, the liquid Color Developers No. 1, No. 8 and No. 15 stored under the conditions adopted above, exclusive of few conditions, were each used in the processing with the automatic developing machine, and examined for their influences upon readability of magnetic information and photographic properties. The results obtained are shown in Tables 8, 9 and 10.

TABLE 8

| Color Developer No. | 1 | 1 | 1 | 8 | 8 | 8 | 8 |
|---|---|---|---|---|---|---|---|
| Vessel | D | D | D | D | D | D | D |
| Void Rate | 0.08 | 0.00 | 0.15 | 0.08 | 0.06 | 0.05 | 0.00 |
| Remaining Rate (%) | | | | | | | |
| Sodium sulfite | 43.7 | 41.0 | 41.5 | 96.2 | 96.0 | 95.2 | 93.0 |
| Hydroxylamine Sulfate | 36.2 | 34.1 | 35.4 | — | — | — | — |
| Present Compound | — | — | — | (6) 93.5 | (6) 93.0 | (6) 92.0 | (6) 91.0 |
| Output (%) | 65 | — | — | 98 | — | 96 | 92 |
| Difference in HD | 0.15 | — | — | 0.00 | — | −0.01 | −0.02 |
| Difference in Dmin | 0.05 | — | — | 0.00 | — | 0.00 | 0.00 |
| Remark | comparison | comparison | comparison | invention | invention | invention | invention |

TABLE 9

| Color Developer No. | 8 | 8 | 8 | 8 | 8 | 8 | 8 |
|---|---|---|---|---|---|---|---|
| Vesel | D | D | A | B | C | C | C |
| Void Rate | 0.15 | 0.20 | 0.08 | 0.08 | 0.08 | 0.05 | 0.15 |
| Remaining Rate (%) | | | | | | | |
| Sodium sulfite | 95.0 | 92.9 | 86.5 | 91.2 | 95.8 | 94.5 | 94.0 |
| Hydroxylamine Sulfate | — | — | — | — | — | — | |
| Present Compound | (6) 92.2 | (6) 90.8 | (6) 87.4 | (6) 90.0 | (6) 93.0 | (6) 91.1 | (6) 91.0 |
| Output (%) | 96 | 91 | 88 | 89 | 97 | 95 | 94 |
| Difference in HD | −0.01 | −0.02 | −0.02 | −0.02 | 0.00 | −0.01 | −0.02 |
| Difference in Dmin | 0.00 | 0.00 | 0.00 | 0.00 | 0.00 | 0.00 | 0.00 |
| Remark | invention | invention | invention | invention | invention | invention | invention |

TABLE 10

| Color Developer No. | 8 | 15 | 15 | 15 | 15 | 15 | 15 |
|---|---|---|---|---|---|---|---|
| Vessel | C | D | D | D | A | B | C |
| Void Rate | 0.00 | 0.20 | 0.08 | 0.00 | 0.08 | 0.08 | 0.08 |
| Remaining Rate (%) | | | | | | | |
| Sodium sulfite | 91.8 | 90.7 | 94.5 | 90.0 | 87.5 | 90.5 | 94.7 |
| Hydroxylamine Sulfate | — | — | — | — | — | — | — |
| Present Compound | (6) 90.5 | (2) 90.1 | (2) 93.0 | (2) 90.4 | (2) 85.4 | (2) 89.5 | (2) 92.5 |
| Output (%) | 91 | 92 | 94 | 90 | 88 | 89 | 94 |
| Difference in HD | −0.02 | −0.03 | −0.01 | −0.01 | −0.02 | −0.02 | −0.01 |
| Difference in Dmin | 0.00 | −0.01 | 0.00 | 0.00 | 0.00 | 0.00 | 0.00 |

TABLE 10-continued

| Color Developer No. | 8 | 15 | 15 | 15 | 15 | 15 | 15 |
|---|---|---|---|---|---|---|---|
| Remark | in-ven-tion | in-ven-tion | in-ven-tion | in-ven-tion | in-ven-tion | in-ven-tion | in-ven-tion |

As can be seen from Tables 8 to 10, in so far as they are charged in the vessels having low $CO_2$-permeating speeds at the void rate ranging from 0.15 to 0.05, the present liquid color developers can ensure higher remaining rates to sodium sulfite and the present compound upon long-term storage and cause only slight changes in photographic properties even when used after the long-term storage, that is, they can retain their excellent properties.

EXAMPLE 4

The processing was carried out in the same manner as in Example 2, except that the liquid Color Developer No. 9 alone was used as the present liquid developer and the stabilizing solution was changed to those having compositions set forth in Table 11, and the evaluation thoreof was made by the same method as in Example 2. Additionally, the stabilizing solution 1 was the same as used in Example 2. The evaluation results thus obtained are shown in Table 12.

TABLE 11

| Ingredient | 1 | 2 | 3 | 4 |
|---|---|---|---|---|
| Sodium p-Toluene-sulfinate | 0.03 g | 0.03 g | 0.03 g | 0.03 g |
| Polyoxyethylene-p-monononylphenyl ether (polymerization degree: 10) | 0.2 g | 0.2 g | 0.2 g | 0.2 g |
| 1,2,4-Triazole | 1.3 g | — | — | — |
| 1,4-Bis(1,2,4-triazole-1-ylmethyl)piperazine | 0.75 g | — | — | — |
| Hexamethylenetetra-mine | — | 5.5 g | — | — |
| Formaldehyde | — | — | 1.1 g | — |
| 1,2-Benzoisothiazoline-3-one | 0.05 g | 0.05 g | 0.05 g | 0.05 g |
| Water to make | 1000 ml | 1000 ml | 1000 ml | 1000 ml |

TABLE 12

| | | | | |
|---|---|---|---|---|
| Color Developer No. | 9 | 9 | 9 | 9 |
| Vessel | D | D | D | D |
| Void Rate | 0.08 | 0.08 | 0.08 | 0.08 |
| Stabilizing Solution No. | 1 | 2 | 3 | 4 |
| Output (%) | 97 | 95 | 97 | 100 |
| Difference in HD | 0.00 | 0.00 | 0.00 | 0.00 |
| Difference in Dmin | 0.00 | 0.00 | 0.00 | 0.00 |

As can be seen from Table 12, no reduction in the output at the time of reading magnetic information was observed when the present liquid color developer was used in combination with the stabilizing solution 4 from which all the magenta dye stabilizers (namely, 1,2,4-triazole, 1,4-bis(1,2,4-triazole-1-ylmethyl)piperazine, hexamethylenetetramine and formaldehyde) were removed.

What is claimed is:

1. A liquid color developer for a silver halide color photosensitive material, wherein said developer is a single color developer solution-type containing at least one compound represented by the following formula (I), containing sulfite in an amount of at least 0.01 mole/λ, and having a specific gravity of from 1.08 to 1.10 at 25° C.:

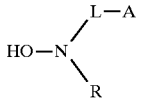

(I)

wherein L represents an unsubstituted or substituted alkylene group; A represents a carboxyl group, a sulfo group, a phosphono group, a hydroxy group, or an unsubstituted or alkyl-substituted amino group; and R represents a hydrogen atom, or an unsubstituted or substituted alkyl group.

2. A liquid color developer as claimed in claim 1, wherein said developer contains hydroxylamine in an amount of not more than 0.02 mole/1.

3. A liquid color developer as claimed in claim 1, wherein said developer is free of hydroxylamine.

4. A liquid color developer as claimed in claim 1, wherein said silver halide color photosensitive material has a magnetic recording layer on a support thereof.

5. A liquid color developer as claimed in claim 1, wherein said developer is charged at a void rate of from 0.15 to 0.05 in a vessel made of a material having a carbon dioxide-permeating speed of 25 ml/($m^2$·24 hrs·atm) or less.

6. A liquid color developer as claimed in claim 1, wherein said compound represented by formula (I) has a specific gravity of from 1.06 to 1.12.

7. A liquid color developer as claimed in claim 1, wherein said color developer contains a specific gravity modifier.

8. A liquid color developer as claimed in claim 1, wherein said compound represented by formula (I) is used in an amount of from 0.001 to 0.2 mole per liter of the developer.

9. A liquid color developer as claimed in claim 1, wherein said compound represented by formula (I) is used in an amount of from 0.005 to 0.07 mole per liter of the developer.

* * * * *